US006862015B2

(12) United States Patent
Fujioka et al.

(10) Patent No.: US 6,862,015 B2
(45) Date of Patent: Mar. 1, 2005

(54) LIQUID CRYSTAL DISPLAY DEVICE

(75) Inventors: Takahiro Fujioka, Mobara (JP); Shigeru Ito, Mobara (JP); Mitsuru Goto, Chiba (JP); Yozo Nakayasu, Mobara (JP); Yoshiyuki Saito, Mobara (JP)

(73) Assignees: Hitachi, Ltd., Tokyo (JP); Hitachi Device Engineering Co., Ltd., Chiba-Ken (JP)

( * ) Notice: Subject to any disclaimer, the term of this patent is extended or adjusted under 35 U.S.C. 154(b) by 129 days.

(21) Appl. No.: 09/836,339

(22) Filed: Apr. 18, 2001

(65) Prior Publication Data

US 2001/0054997 A1 Dec. 27, 2001

(30) Foreign Application Priority Data

May 18, 2000 (JP) ..... 2000-146603

(51) Int. Cl.[7] ..... G09G 3/36
(52) U.S. Cl. ..... 345/98; 345/87
(58) Field of Search ..... 345/55, 87–100, 345/213, 504; 348/558, 589; 375/576; 377/47; 713/600

(56) References Cited

U.S. PATENT DOCUMENTS 5,091,784 A * 2/1992 Someya et al. ..... 348/589
5,689,536 A * 11/1997 Iyota et al. ..... 375/376
5,754,838 A * 5/1998 Shibata et al. ..... 713/600
5,926,174 A * 7/1999 Shibamiya et al. ..... 345/213
6,078,361 A * 6/2000 Reddy ..... 348/558
6,128,025 A * 10/2000 Bright et al. ..... 345/504
6,144,355 A * 11/2000 Murata et al. ..... 345/99
6,211,849 B1 * 4/2001 Sasaki et al. ..... 345/55
6,437,768 B1 * 8/2002 Kubota et al. ..... 345/100
6,483,888 B1 * 11/2002 Boerstler et al. ..... 377/47

* cited by examiner

*Primary Examiner*—Dennis-Doon Chow
*Assistant Examiner*—Srilakshmi K. Kumar
(74) *Attorney, Agent, or Firm*—Reed Smith LLP; Stanley P. Fisher, Esq.; Juan Carlos A. Marquez, Esq.

(57) ABSTRACT

A liquid crystal display device capable of improving display quality by enabling proper execution of receipt and acceptance of image signals through compensation for variation in duty ratios of clock signals as input to liquid crystal driver circuitry, is provided. In a liquid crystal display device comprising a liquid crystal display element and liquid crystal driver circuitry, the liquid crystal driver circuitry is operable to receive an image signal as input thereto for taking it into a bus at the timing of a change of an internal clock signal from a first level to a second level or alternatively its change from the second level to the first level and then select from the image signal as taken or "accepted" into the bus a voltage used to drive the liquid crystal display element, wherein the internal clock signal is the clock signal that causes a first level period and a second level period of an external clock signal being input to the liquid crystal driver circuitry to be made identical or equalized by a clock compensation circuit to specified values respectively.

15 Claims, 22 Drawing Sheets

200
CL2i
CLRi
H348
Mi
CL1i
CL
Mo
CL1o
CL2o
Eo
Do00~05
Do10~15
Do20~25
POLo
Ei
Di00~05
Di10~15
Di20~25
POLi
VCC
GND
VLCD
GND
V0i~V4i
V5i~V9i
V0o~V4o
V5o~V9o
Y384
Y1Y2Y3Y4Y5
Clock Controler
131
Latch Address Selector
132
133
134
Latch Circuit
135
Latch Circuit (2) Level Shifter
136
Decoder
137
Buffer Amp.
138
Gradation Voltage Generator
139

LIQUID CRYSTAL DISPLAY DEVICE

BACKGROUND OF THE INVENTION

1. Field of the Invention

The present invention relates generally to liquid crystal display devices and, more particularly, to effectual techniques adaptable for use with driver circuitry of a liquid crystal display device of the type which employs schemes for transferring a digital signal between drive circuits (drain drivers).

2. Description of the Related Art

Liquid crystal display modules of the type using super twisted nematic (STN) schemes or those of the thin-film transistor (TFT) type have been widely employed as display devices of notebook personal computers or else.

These liquid crystal display devices are typically designed to include a liquid crystal display panel and drive circuitry for driving the liquid crystal display panel.

And, in such liquid crystal display devices, one prior known device is disclosed in, for example, Japanese Patent Laid-Open No. 13724/1994, which is designed to input a digital signal (e.g., either display data or clock signal) only to a "top" driver circuit of multiple cascade-connected driver circuits while causing the digital signal to be sequentially transferred to the remaining driver circuits through inside of such driver circuits (this will be referred to as "digital signal sequential transfer scheme" hereinafter in the description).

While in the liquid crystal display device as taught from the above-identified Japanese document (Japanese Patent Laid-Open No. 13724/1994) semiconductor integrated circuit (IC) devices making up the driver circuitry are directly mounted on a glass substrate of the liquid crystal display panel, another liquid crystal display device of the type employing the above-noted digital signal sequential transfer scheme is also known, which is with semiconductor integrated circuit (IC) devices making up this driver circuitry being mounted on a tape carrier package, as recited for example in Japanese Patent Laid-Open No. 3684/1994.

Additionally, the related art technique for transferring in driver circuitry of the digital signal sequential transfer scheme type a polarity-inverted signal to a driver circuit of the next stage in order to cancel any possible variation or deviation of the duty ratio of a signal is disclosed in *SHARP Technical Bulletin*, No. 74 (August in 1999) at pp. 31–34. Any one of the above-cited related art references fails to teach nor suggest in any way a clock compensation circuit for making the rise-up timing of a clock signal identical to the fall-down timing thereof.

As shown in FIG. 32A, in the case of so-called dual edge accept/import scheme for receiving and taking thereinto—say, accepting or "importing"—display data both at the rise-up time point of a display data accepting clock signal and the fall-down point thereof, it should be required that the riseup point and falldown point of such clock signal be identical to an intermediate time point of changeover time of display data in order to provide a margin or "clearance" to a setup period and a hold period.

However, with liquid crystal display devices of the type which employ the above-stated digital signal sequential transfer scheme, any display data and clock signal(s) as sent out of a timing controller (or alternatively display control device) are expected to propagate over signal lines within respective driver circuits and transfer lines between respective driver circuits (transfer lines on a glass substrate or those on a tape carrier package).

In other words, the display data and clock signal(s) as sent out of the timing controller will be delivered and passed between respective drain drivers in a one-by-one manner.

For this reason, the duty ratio of a clock signal (namely, the ratio of a "High" level period to the cycle or period of a pulse signal) can deviate due to a variation in the internal characteristics of each drain driver—e.g., threshold voltage (Vth) of each MOS transistor in a CMOS inverter circuit—and/or some factors on transfer lines; and simultaneously, a plurality of repeated signal receive-and-pass events would result in such duty ratio variations being accumulated unwontedly.

And, if the clock signal's duty ratio variation increases causing the resultant phase difference relative to display data to increase accordingly, as shown in FIG. 32B, either the setup period or the hold period in the case of accepting display data in response to a clock signal decreases: in the worst case, it will become impossible to accept any display data at each driver circuit, which leads to occurrence of erroneous display on the liquid crystal display panel, resulting in an appreciable decrease in display quality.

Although the problems discussed above become more remarkable in the case of the scheme for accepting display data at both edges of a clock signal, similar problems might occur in the case of schemes for accepting display data at either one edge of the clock signal.

SUMMARY OF THE INVENTION

The present invention has been made to avoid the problems faced with the related art, and a primary object of this invention is to provide a technique used in a liquid crystal display device for enabling compensation of any possible variation in duty ratio of one or more clock signals as input to liquid crystal driver circuitry.

It is another object of the invention to provide a technique used in the liquid crystal display device for guaranteeing correct execution of image signal accepting or "importing" operations to thereby improve the display quality of a liquid crystal display element thereof.

The foregoing and other objects and features unique to the instant invention will be apparent from the following more particular description of preferred embodiments of the invention, as illustrated in the accompanying drawings.

A representative one of some principal concepts of the invention as disclosed herein will be briefly set forth below.

A liquid crystal display device in accordance with the instant invention is the one that comprises a liquid crystal display element and liquid crystal driver circuitry, wherein the liquid crystal driver circuitry is operable to receive an image signal as input to the liquid crystal driver circuitry and take—say, accept or "import"—this signal onto its bus at the timing of a change of an internal clock signal from its first level to second level or alternatively from the second to the first level and then select from the image signal thus accepted or imported to the bus a specific voltage used to drive the liquid crystal display element. The internal clock signal is featured in that this is a clock signal which causes a first level period and a second level period of an external clock signal being input to the liquid crystal driver circuitry to be made identical or equalized by a clock compensation circuit to prespecified values respectively.

According to the means, it permits the intended internal clock signal to be generated at each liquid crystal driver circuit, which signal causes the first level period and second level period of an external clock signal as input to the liquid crystal driver circuitry to be made identical by the clock compensation circuit to prespecified values respectively; thus it becomes possible to well compensate for any possible variation or deviation in duty ratios of externally input clock signals.

Whereby, it becomes possible to accurately accept or import the intended display data at each liquid crystal driver circuit, which in turn makes it possible to improve the display quality of the liquid crystal display element.

The above-noted clock compensation circuit is configured from either a phase-locked loop circuit or a delay locked loop circuit.

Furthermore, letting the internal clock signal be output to a liquid crystal driver circuit of the next stage makes it possible to suppress or minimize unwanted variation of the duty ratio of any clock signal more successfully when compared to the case of directly outputting an externally input clock signal to the next-stage liquid crystal driver circuit.

The external input clock signal's duty ratio variation compensation may be achieved by a process including the steps of forming a first clock signal and a second clock signal as generated through inversion of the first clock signal, and then supplying the first clock signal to a second clock signal system of a liquid crystal driver circuit of the next stage while supplying the second clock signal to a first clock signal system of such next-stage liquid crystal driver circuit.

Whereby, it becomes possible to accurately accept display data by each liquid crystal driver circuit, thus enabling improvement of the display quality of the liquid crystal display element.

In addition, since the power supply of display data transfer circuitry is separated from that of clock signal transfer circuitry, it is possible to suppress influence of the display data transfer circuitry upon the clock signal transfer circuitry.

DETAILED DESCRIPTION OF THE PREFERRED EMBODIMENTS

Figure 1:
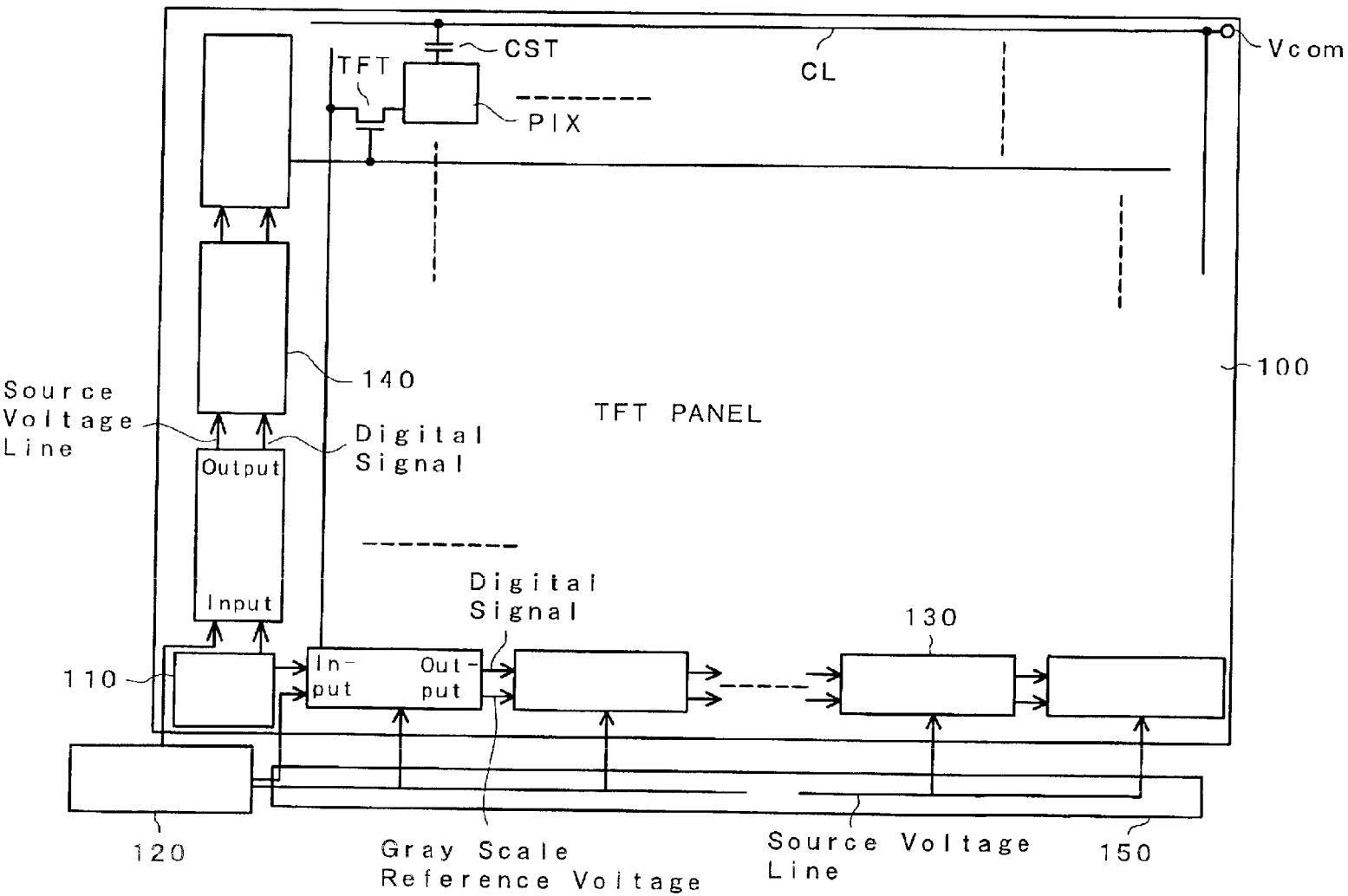
FIG. 1 is a block diagram showing a basic configuration of a display panel of a liquid crystal display module in accordance with an embodiment 1 of the present invention.

Preferred embodiments of the present invention will now be explained in detail with reference to the accompanying drawings below.

Note here that in all the attached drawings for explanation of the embodiments, those having the same functionalities will be designated by the same reference characters and any repetitive explanation thereof will be omitted in the description.

Embodiment 1

FIG. 1 is a block diagram showing a basic configuration of a display panel of a liquid crystal display module in accordance with an embodiment 1 of the present invention.

As shown in this drawing, the liquid crystal display module of this embodiment is generally made up of a liquid crystal display panel 100, a timing controller 110, a power supply circuit 120, drain drivers 130, gate drivers 140, and a flexible printed wiring substrate (referred to hereinafter as "FPC substrate") 150.

The liquid crystal display panel 100 includes a TFT substrate with pixel electrodes PIX and thin-film transistors TFT and others being formed thereon and a filter substrate with more than one opposite or "counter" electrode and color filters formed thereon, which substrates are spatially stacked or laminated over each other at a specified distance, wherein a seal material that is provided adjacent to peripheral portions between the both substrates and has a rectangular frame-like shape is used for adhesion between the both substrates while letting a chosen liquid crystal material be encapsulated from a liquid crystal encapsulation inlet port into the inside space of the seal material between the both substrates and sealed therein and further letting polarizer plates be bonded to outer sides of the both substrates.

Each picture element or "pixel" consists essentially of a pixel electrode PIX and a thin-film transistor TFT, which may be provided at a corresponding one of certain portions whereat a plurality of scan signal lines (also known as gate signal lines) G and multiple image signal lines (also called drain signal lines) D cross over each other.

Note that in the illustrative embodiment, a storage capacitor CST is provided per each pixel in order to hold or retain a voltage of the pixel electrode PIX.

"CL" designates a capacitance line for supplying a reference voltage Vcom to storage capacitors CST.

Optionally the capacitance line CL may be replaced by a scan signal line G of a previous line.

The thin-film transistor TFT of each pixel has a source connected to a pixel electrode PIX, a drain connected to an image signal line D, and a gate connected to a scan signal line G, wherein this transistor functions as a switch for supplying a display voltage (gradation or "grays-scale" voltage) to the pixel electrode PIX.

It should be noted that although the names of the "source" and "drain" are interchangeable depending upon the relation of biassing used, the one that is connected to the image signal line D is here be called the drain.

The timing controller 110 and drain drivers 130 plus gate drivers 140 are mounted respectively on a transparent dielectric substrate (glass substrate) that makes up the TFT substrate of the liquid crystal display panel 100.

And, as stated previously, more than one digital signal (display data, clock signal(s), etc.) as sent out of the timing controller 110 and a gradation reference voltage as supplied from the power supply circuit are input to the first or "top" one of the drain drivers 130 and are then transferred via an internal signal line within each drain driver 130 and a transfer line (transfer line on the glass substrate) between respective drain drivers 130 to be input to each drain driver 130.

Here, the power supply voltage of each drain driver 130 is supplied to each drain driver 130 from the power supply circuit 120 via the FPC substrate 150.

Similarly a digital signal (clock signal or else) as has been sent out of the timing controller 110 is input to the top gate driver 140 and then travels along the internal signal line within each gate driver 140 and the transfer line (transfer line on the glass substrate) between respective gate drivers 140 to be input to each gate driver 140.

Note here that on the gate driver side, a power supply voltage as supplied from the power supply circuit 120 is also supplied to the top gate driver 140 and then supplied to each gate driver 140 via an internal power supply within each gate driver 140 and the transfer line (transfer line on the glass substrate) between respective gate drivers 140.

The timing controller 110 is formed of a single semiconductor integrated circuit (LSI), which is operable to control and drive the drain drivers 130 and gate drivers 140 on the basis of display data (R·G·B) and respective display control signals as sent from a computer main body side, including a clock signal(s), a display timing signal(s), a horizontal synchronization signal and a vertical sync signal.

The gate drivers sequentially supply a "High" level select scan voltage to each gate signal line G of the liquid crystal display panel 100, one at a time whenever a single horizontal scanning time is elapsed, on the basis of a frame start instruction signal (FLM) and a shift clock (CL3) which are sent out of the timing controller 110.

Whereby a plurality of thin-film transistors (TFTs) as connected to each gate signal line G of the liquid crystal display panel 100 will be electrically conducted within a single horizontal scan time period.

Figure 2:
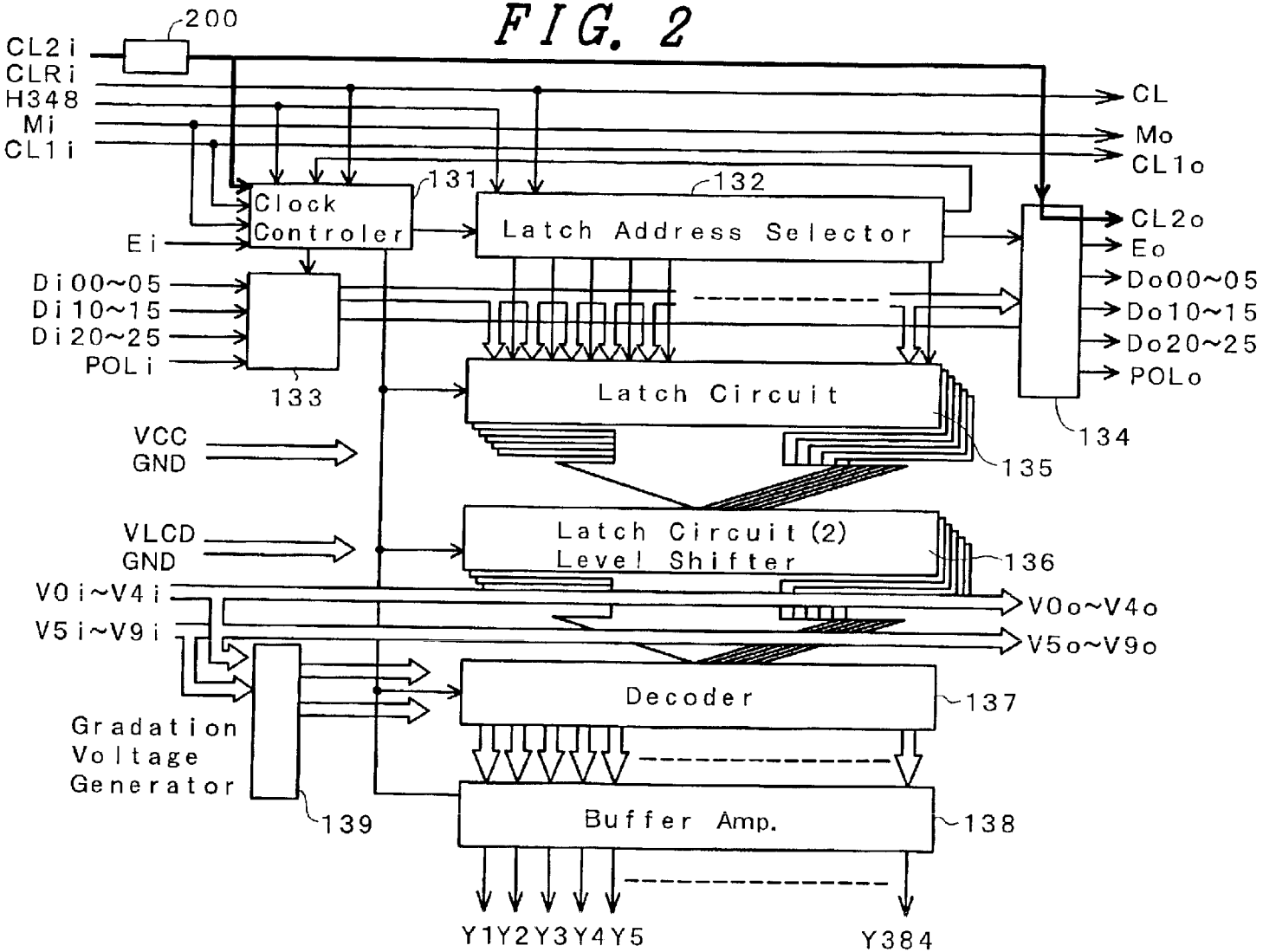
FIG. 2 is a block diagram showing schematically showing a configuration of a drain driver shown in FIG. 1.

FIG. 2 is a block diagram showing a schematical arrangement of the drain driver 130 shown in FIG. 1. Note that suffix "i" used in FIG. 2 refers to a signal as input from outside of the drain driver 130 whereas suffix "o" is understood to mean a signal as will be externally output from the drain driver 130 after propagation through inside of the drain driver 130.

For instance, "CL2*i*" designates a display data latching clock signal as input externally. The display data latch clock signal is to be output to the outside (a drain driver 130 of the next stage) after propagation through inside of the drain driver 130. A display data latch clock signal as will be output to the outside from the drain driver 130 is indicated by "CL2*o*."

A clock compensation circuit 200 shown in this drawing generates, based on the externally input display data latch clock signal (CL2*i*), an internal clock signal with its duty ratio of 50% (i.e. a clock signal with its High level period and Low level period being equal to each other) (CLL2).

A latch circuit (1) 135 shown herein sequentially latches display data as sent out of a data accept/processing circuit 133, based on a data accept signal as sent out of a latch address selector 132.

Additionally the display data being sent out of the data accept/processing circuit 133 will be output to the outside through a data output circuit 134.

Here, the latch address selector 132 generates the data accept signal based on an internal clock signal (CLL2) as sent out of a clock control circuit 131.

A latch circuit (2) 136 accepts the display data being latched at the latch circuit (1) 135 based on an output timing control clock (CL1) that is sent out of the clock control circuit 131.

A decoder circuit 137 selects from among gradation voltages of 64 gray scales as supplied from a gradation voltage generator circuit 139 a gradation voltage that corresponds to the display data being sent out of the latch circuit (2) 136 and then outputs it to an amplifier circuit 138.

The amplifier circuit 138 amplifies (current-amplifies) the gradation voltage as sent out of the decoder circuit 137 and then supplies the resultant amplified voltage to each drain signal line D (Yi).

With the above-noted operations, an image is visually displayed on the liquid crystal display panel 100.

It should be noted that although the decoder circuit 137 and amplifier circuit 138 are made up of a circuit of the positive polarity and a circuit of the negative polarity respectively, a detailed explanation thereof will be omitted herein.

Additionally, the gradation voltage generator circuit 139 generates, based on externally supplied gradation reference voltages (V0–V4) of the positive polarity, gradation voltages of 64 gray scales with the positive polarity and also generates gradation voltages of 64 gray scales with the negative polarity on the basis of externally supplied gradation reference voltages (V5–V9) of the negative polarity.

Figure 3:
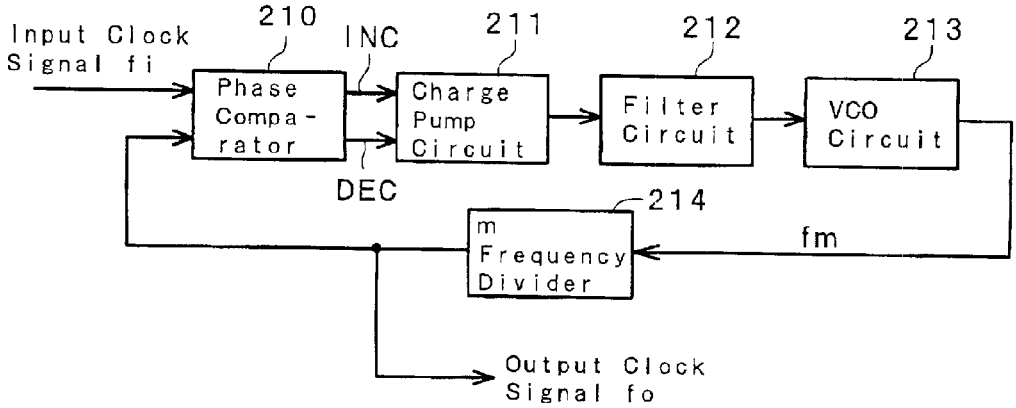
FIG. 3 is a block diagram showing one example of a clock compensation circuit shown in FIG. 2.

FIG. 3 is a block diagram showing one example of the clock compensation circuit 200 shown in FIG. 2.

The clock compensation circuit 200 shown in FIG. 3 is the circuit that is designed to employ a phase-locked loop (PLL) circuit.

This clock compensation circuit 200 using such PLL circuit is less in circuit occupation area, which is advantageous for size reduction of the drain driver circuitry while at the same time reducing peripheral regions of the liquid crystal display panel.

The circuitry shown in FIG. 3 is generally constituted from a phase comparator 210, charge pump circuit 211, filter circuit 212, voltage-controlled oscillation (VCO) circuit 213, and frequency m-divider 214.

In this PLL circuit, the phase comparator 210 is for comparing an input clock signal (fi) with an output clock signal (fo) as output from the frequency m-divider 214.

When the phase lead/lag comparison result indicates that the input clock signal (fi) advances in phase than the output clock signal (fo), the phase comparator 210 outputs a phase lag pulse (INC); if the input clock signal (fi) is delayed in phase from the output clock signal (fo) then the phase comparator 210 outputs a phase lead pulse (DEC).

The charge pump circuit 211 converts either the above-noted phase lag pulse (INC) or the phase lead pulse (DEC) into a current pulse whereas the filter circuit 212 uses the current pulse based on the afore the phase lag pulse (INC) to potentially increase an internal capacitor or alternatively uses the current pulse based on the phase lead pulse (DEC) to cause the internal capacitor to decrease in potential.

The VCO circuit 213 is formed of either a ring oscillator or an emitter-coupled astable multivibrator circuit or else and operable based on this internal capacitor's potential to change or vary the oscillation frequency of a clock signal (fm).

Whereby the input clock signal (fi) becomes identical in both frequency and phase to the output clock signal (fo).

The reason why an output clock signal (fo) with its duty ratio of 50% is obtainable by the PLL circuit shown in FIG. 3 from an input clock signal (fi) whose duty ratio is not 50% will be explained with reference to FIG. 4 below.

Figure 4:
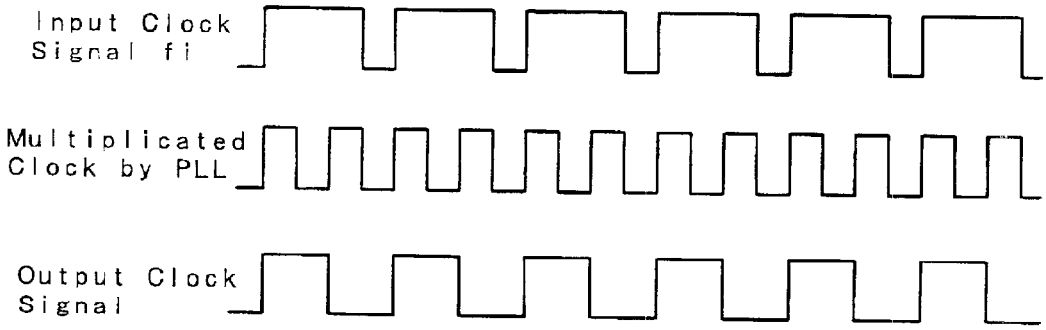
FIG. 4 is a diagram for explanation of a reason for obtainability by the circuit shown in FIG. 3 of an output clock signal (fo) with its duty ratio of 50% from an input clock signal (fi) whose duty ratio is not 50%.

Note that FIG. 4 shows a timing chart in case the VCO circuit 213 is designed to output a clock signal (fm) having its frequency which is two times greater than that of the input clock signal (fi) with the frequency m-divider 214 being formed of a frequency two-divider or "bidivider."

As shown in FIG. 4, in case the input clock signal (fi) whose duty ratio is not 50% is synchronous with the output clock signal (fo), the VCO circuit 213 operates to output a clock signal (fm) which is two times greater in frequency than the input clock signal (fi).

While this clock signal (fm) is frequency-divided by the frequency bidivider to become the output clock signal (fo), the output clock signal (fo) becomes a clock signal which is potentially changes from its "High" level to "Low" level and changes from the Low to High level at a rise-up point (or alternatively fall-down point) of the clock signal (fm); thus, this output clock signal (fo) becomes a clock signal with its duty ratio of 50%.

Additionally, in view of the fact that the clock signal (fm) with its duty ratio of 50% will not always be obtained from the VCO circuit 213, the frequency m-divider 214 of the PLL circuit shown in FIG. 3 is provided in order to finally obtain the intended output clock signal (fo) with its duty ratio of 50%.

Figure 5:
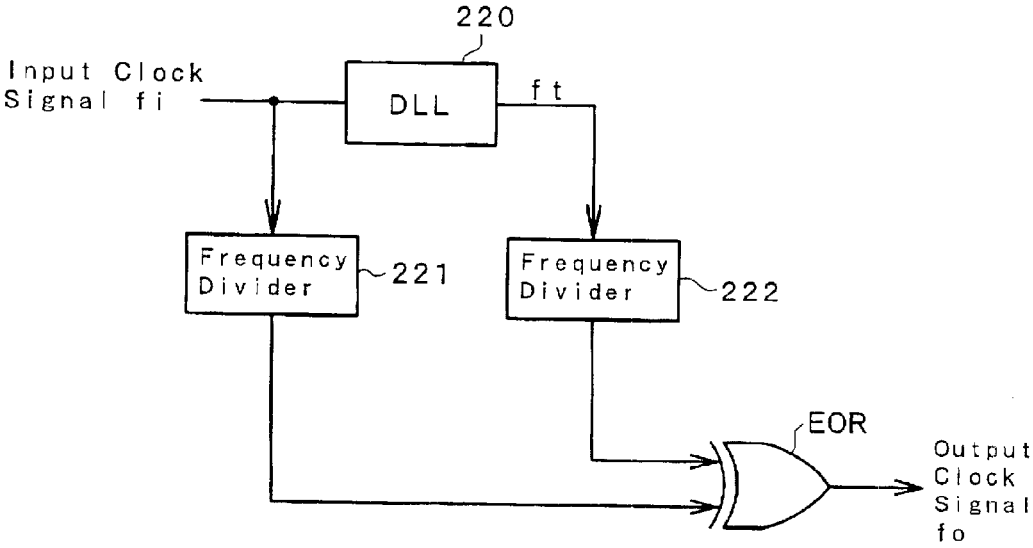
FIG. 5 is a block diagram showing another example of the clock compensation circuit shown in FIG. 2.

FIG. 5 is a block diagram showing another example of the clock compensation circuit 200 shown in FIG. 2.

The clock compensation circuit 200 shown in FIG. 5 is the circuit using a delay locked loop (DLL) circuit.

Although this clock compensation circuit using the DLL circuit requires an increased circuit occupation area as compared to that using the PLL circuit because of the fact that it additionally has a delay line(s), it does no longer require any high-speed signals to thereby offer increased operation stabilities: the frequency of a signal will hardly increase even when the liquid crystal display panel increases in pixel number, so that stable operations become achievable.

The circuitry shown in FIG. 5 is configured from a DLL circuit 220 frequency bidividers (221, 222), and an exclusive-OR logic circuit (EOR).

Figure 6:
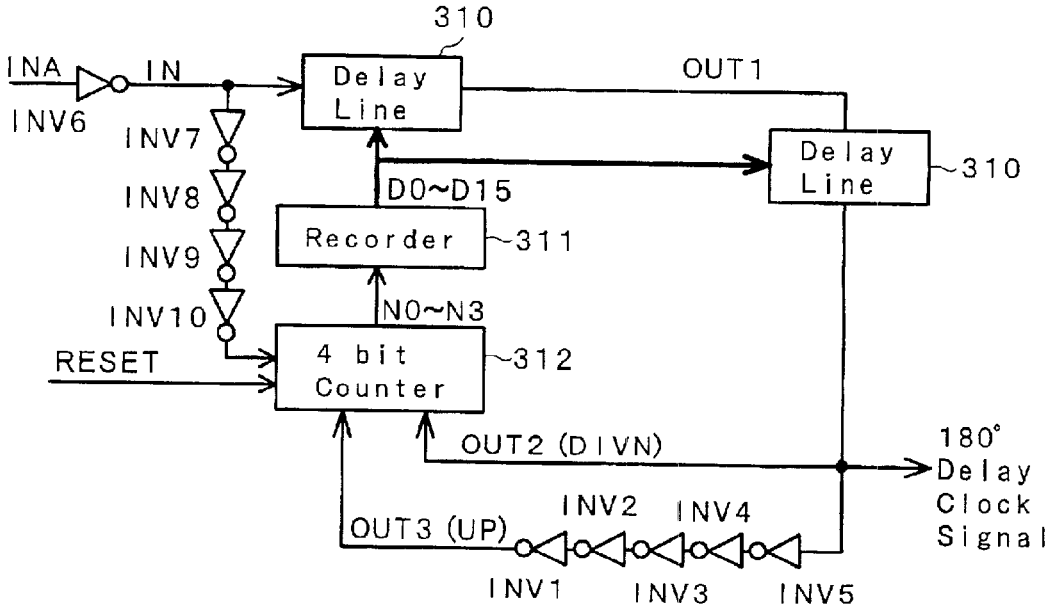
FIG. 6 is a circuit diagram showing a circuit configuration of a DLL circuit shown in FIG. 5.
Figure 7:
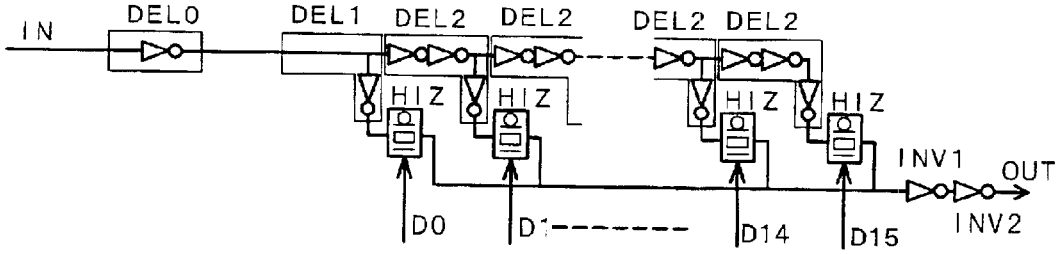
FIG. 7 is a circuit diagram showing a configuration of a delay line shown in FIG. 6.

FIG. 6 is a circuit diagram showing a circuit configuration of the DLL circuit 220 shown in FIG. 5 whereas FIG. 7 is a circuit diagram showing an arrangement of a delay line 310 shown in FIG. 6.

Figure 8:
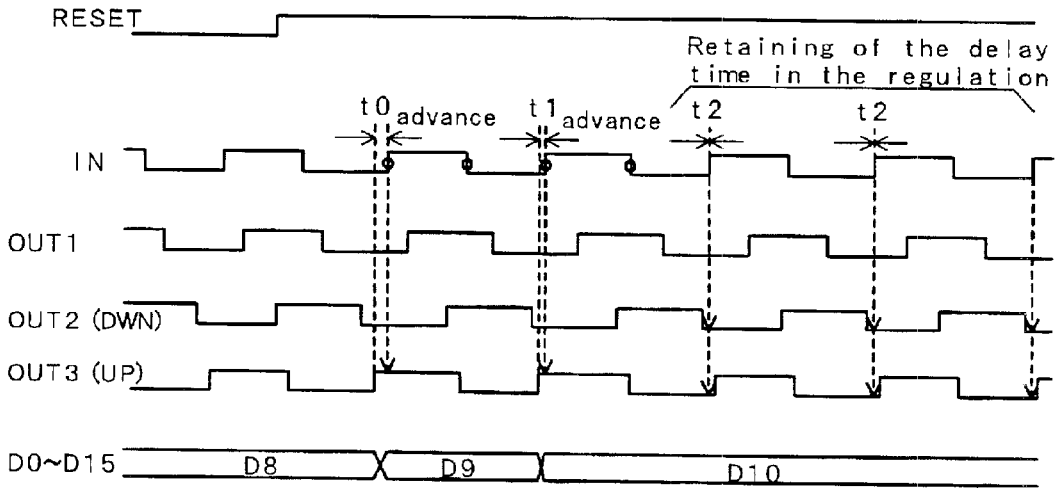
FIG. 8 is a diagram showing a timing chart of the circuit shown in FIG. 6.

In addition, FIG. 8 is a diagram showing a timing chart of the circuitry shown in FIG. 6.

In the DLL circuit shown in FIG. 6 an up-down counter 312 is operable to increase a counter value by "+1" in order to further delay the phase in the event that an OUT2 (DWN) is at "High" level whereas an OUT3 is at "Low" level with respect to a rise-up edge of an input (IN).

A decoder circuit 311 decodes the count value of the up-down counter 312 causing one of switch elements (HIZ) of the delay line 310 corresponding to the subject count value to turn on, thereby increasing delay elements DEL on the signal line thus causing the delay line 310 to increase in its delay time accordingly.

Adversely, when the OUT2 (DWN) is at Low level whereas OUT3 (UP) is at High level with respect to the riseup edge of the input (IN), the up-down counter 312 decreases the counter value by "−1" in order to let a too delayed or lagged phase return at its original value.

The decoder circuit 311 decodes the count value of the up-down counter 312 causing one of the switch elements (HIZ) of the delay line 310 corresponding to this count value to turn on, thereby decreasing the delay elements DEL on the signal line thus causing the delay line 310 to likewise decrease in delay time thereof.

Alternatively, if both OUT2 (DWN) and OUT3 (UP) are at the Low level with respect to the riseup edge of the input (IN) then the up-down counter 312 assumes that the phases are identical with each other and thus holds its present counter value.

Whereby, a clock signal (ft) is obtained from OUT2, the phase of which signal is 180° delayed with respect to the input clock signal (fi).

The reason why an output clock signal (fo) with its duty ratio of 50% is obtainable by the circuitry shown in FIG. 5 from an input clock signal (fi) whose duty ratio is not 50% will be explained with reference to FIG. 9 below.

Figure 9:
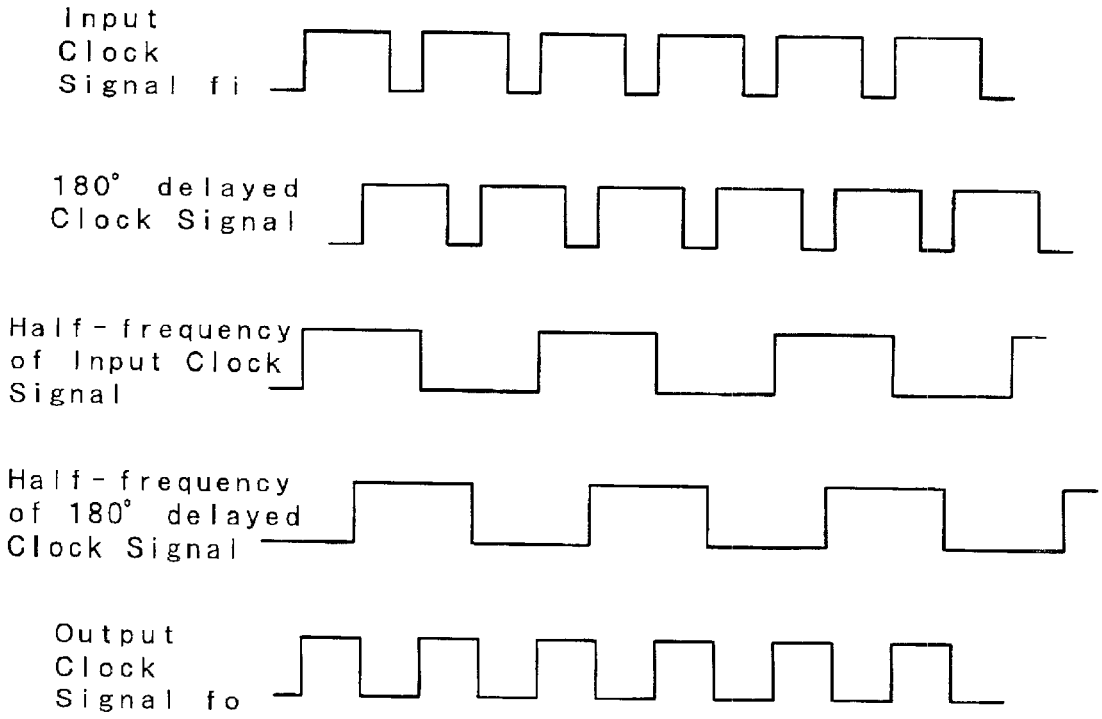
FIG. 9 is a diagram for explanation of a reason for obtainability by the circuit shown in FIG. 5 of an output clock signal (fo) with its duty ratio of 50% from an input clock signal (fi) whose duty ratio is not 50%.

As shown in FIG. 9 a clock signal (ft) with its phase being 180° delayed with respect to an input clock signal (fi) whose duty ratio is not 50% is obtained from the DLL circuit 220.

This input clock signal (fi) is input to the frequency bidivider 221 whereas the clock signal (ft) with its phase 180° delayed is input to the other frequency bidivider 222 resulting in obtainment of a frequency-bidivided clock signal required.

In this case, as previously described, since the clock signal that has been frequency-divided by frequency bidivider becomes a clock signal which changes from its High level to Low level and from Low to High level at a fall-down point at a rise-up (or drop-down) time point (e.g., of the input clock signal (fi)) prior to such frequency bidivision processing, the clock signal as frequency-divided by this frequency bidivider becomes a clock signal with its duty ratio of 50%.

Letting resultant clock signals as frequency-bidivided by these frequency bidividers (221, 222) be input to the exclusive-OR circuit (EOR) makes it possible to obtain an output clock signal (fo) with its duty ratio of 50% in synchronization with the input clock signal (fi).

Note that while the clock compensation circuit 200 shown in FIG. 3 offers an advantage as to an ability to lessen its circuit scale, it suffers from a disadvantage as to the necessity of high-speed operations.

In contrast, the clock compensation circuit 200 shown in FIG. 5 has a merit of requiring no high-speed operations; however, it suffers from a demerit as to an increase in resultant circuit scale.

Accordingly, when assembling the clock compensation circuit 200 of the invention into real products, the above-noted merit and demerit should be carefully taken into consideration.

Figure 10:
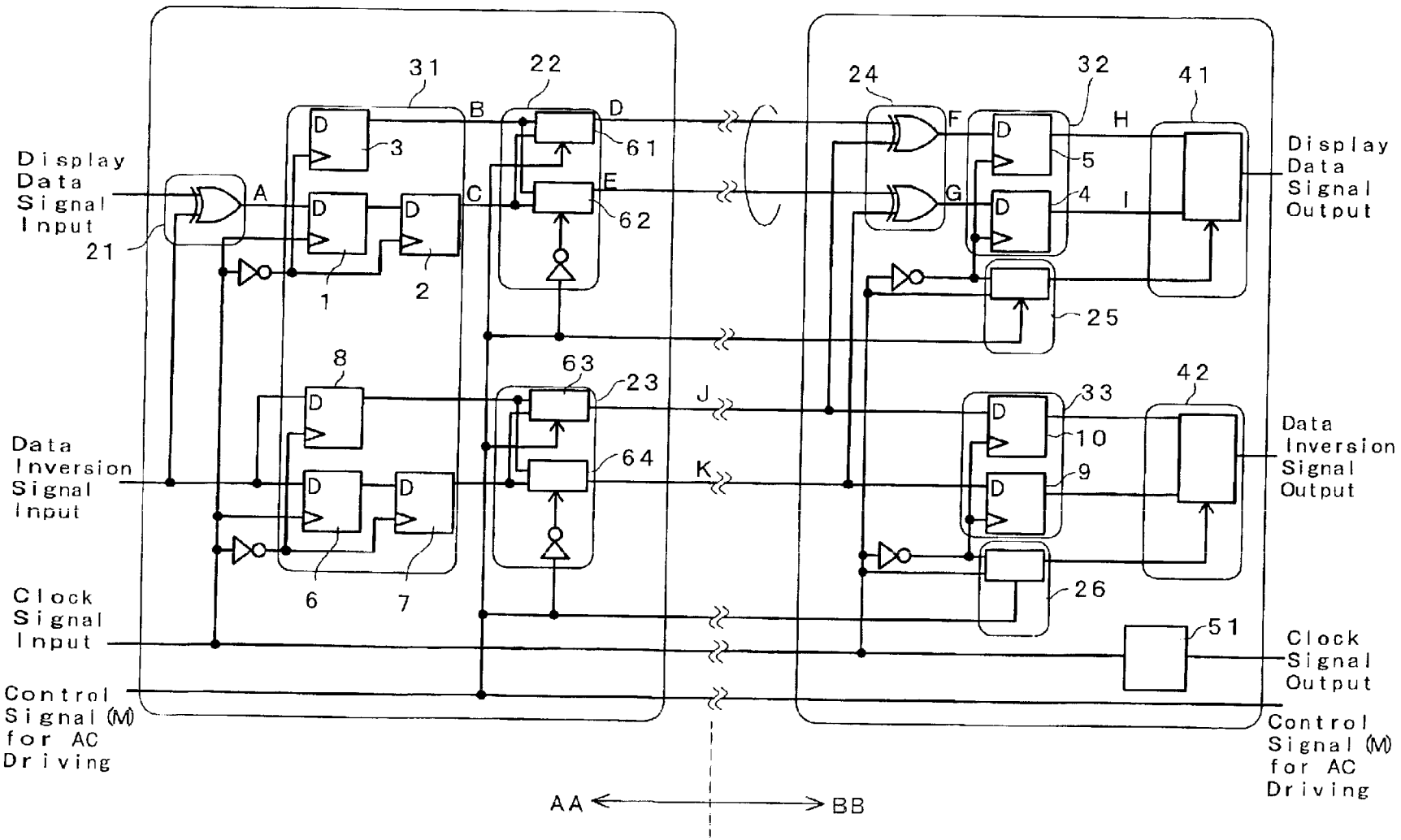
FIG. 10 is a circuit diagram showing circuit configurations of a data accept/processing circuit and a data output circuit used in the embodiment 1 of this invention.

An explanation will next be given of the data accept/processing circuit 133 and data output circuit 134 shown in FIG. 2. FIG. 10 is a circuit diagram showing circuit configurations of the data accept/processing circuit 133 and data output circuit 134.

In FIG. 10, part on the left side of dotted line (in the direction of arrow "AA") is the data accept/processing circuit 133 whereas the remaining part on the right side of the dotted line (in the direction of arrow "BB") is the data output circuit 134.

As shown in this drawing, the data accept/processing circuit 133 is constituted from arithmetic (logical) operational circuits (21, 22, 23) and a latch circuit 31 whereas the data output circuit 134 is formed of operational circuits (24, 25, 26) and latch circuits (32, 33) along with multiplex circuits (41, 42) and a delay circuit 51.

Note here that in FIG. 10, a specific case is illustrated where internal signal lines for display data transmission are designed by co-use of those internal bus lines that are inherently used to output liquid crystal drive voltages of the drain drivers 130.

An operation of a respective component will be explained below.

Figure 11:
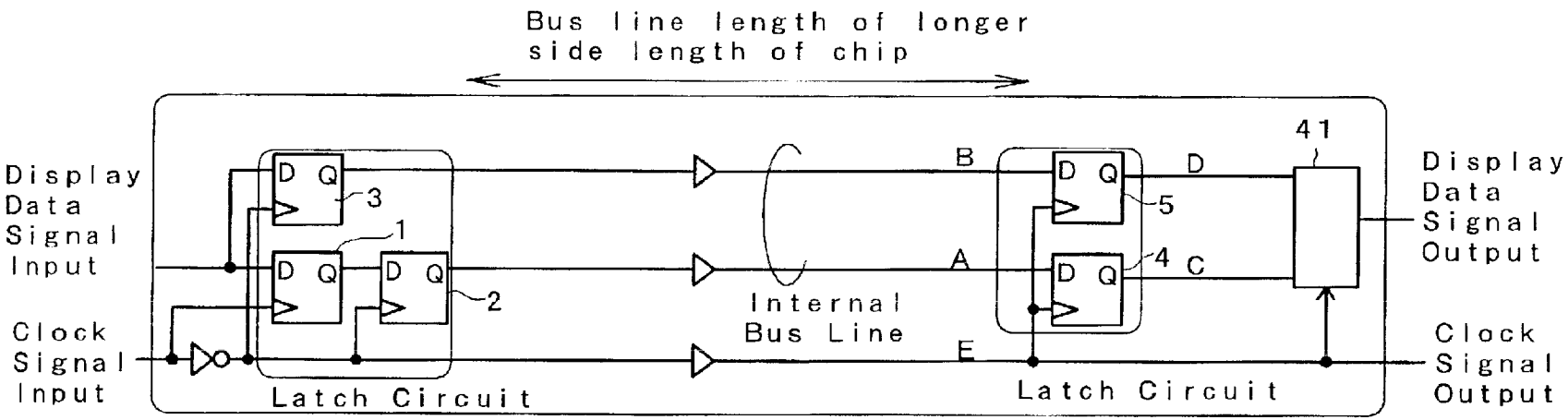
FIG. 11 is a diagram showing a circuit configuration per internal bus line in the circuit diagram shown in FIG. 10.
Figure 12:
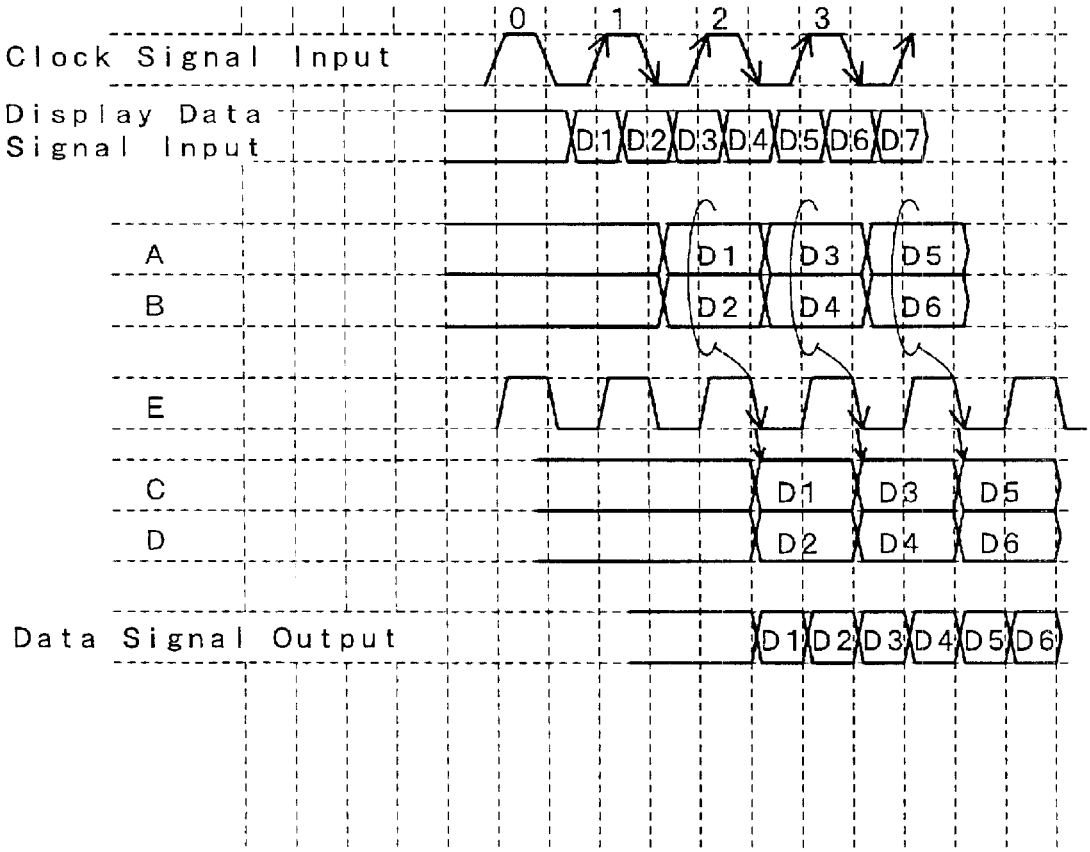
FIG. 12 is a diagram showing a timing chart of a clock signal (CLL2) and display data plus display data on an internal signal line shown in FIG. 11.

FIG. 11 is a diagram showing a circuit configuration per single internal bus line in the circuit diagram shown in FIG. 10 whereas FIG. 12 is a diagram showing a timing chart of a clock signal (CLL2) and display data plus display data on an internal signal line shown in FIG. 11.

Note that depiction of the operational circuits (21, 22, 24, 35) is eliminated in FIG. 11.

As shown in FIG. 12, externally input display data (D1) is taken or "accepted" into a D-type flip-flop circuit (simply referred to as "flip-flop circuit" hereinafter) 1 at a time point of rise-up of a clock signal (CLL2).

In addition, at a fall-down point of the clock signal (CLL2), externally input display data (D2) is accepted into a flip-flop circuit 3 and is then output onto an internal bus line B; simultaneously, the display data (D1) being accepted into the flip-flop circuit 1 is taken into a flip-flop circuit 2 and then output onto an internal bus line A.

With this embodiment the display data will be sent out onto the internal bus lines at the same timing in the way stated above.

Note that the reason why the internal bus lines are formed of two systems of bus lines will be set forth later in the description.

The data bits sent out onto the internal bus lines (A, B) are to be transferred in the longitudinal direction of the drain drivers 130, that is, along the longer side lengths of semiconductor chips involved; thus, a delay can occur due to lead wire resistivities and lead capacitances of the internal bus lines resulting in creation of phase deviation or offset relative to the clock signal (CLL2).

Due to this, let the display data (D1) on the internal bus line be taken into a flip-flop circuit 4 at a rise-up time point of the clock signal (CLL2) while at the same time accepting the display data (D2) on the internal bus line into a flip-flop circuit 5 to thereby absorb the phase offset stated supra.

Additionally, the display data bits as have been taken into the flip-flop circuit 4 and flip-flop circuit 5 will be alternately output to the outside by the multiplex circuit (switch circuit) 41.

Whereby the display data bits to be externally output will be output to the outside in the order of sequence that they were input externally.

With the related art technique for outputting a polarity-inverted signal for transfer toward a drain driver at the next stage (SHARP Technical Bulletin, No. 74 (August 1999) at pp. 31–34), it should be required that positive-polarity logic drain drivers and negative logic drain drivers be alternately cascade-connected; thus, two different types of drain drivers must be used, resulting in presence of demerits including an increase in costs of such drain drivers and an increase in complexity of liquid crystal display device assembly processes leading to the incapability of improving manufacturing yields thereof.

However, with the present invention, provision of the circuit for compensation of the duty of the clock signal (CL2) avoids the need to invert any transfer data while allowing the use of drain drivers of single type. Accordingly, the following effects and advantages are available: the drain drivers do not increase in cost while making easier liquid crystal display device assembly processes with a significant increase in production yields thereof.

Figure 13:
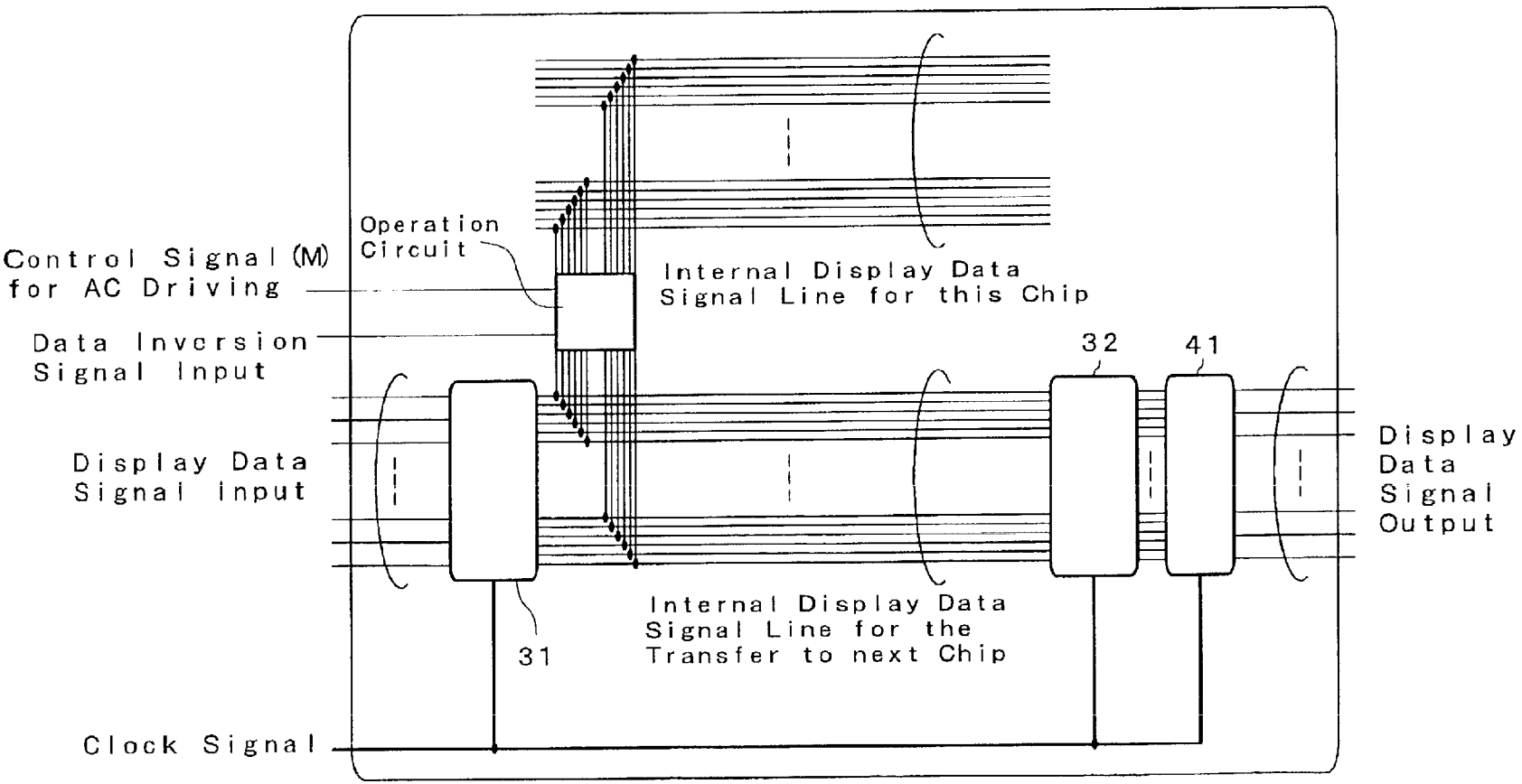
FIG. 13 is a diagram showing the individuality of a case where internal signal lines for display data transfer are provided separately from internal bus lines.

Note that although in FIG. 10 the specific case was explained where the display data transferring internal signal lines are for co-use with those internal bus lines used to output liquid crystal drive voltages of the drain drivers 130, such display data transfer internal signal lines may alternatively be provided separately from the internal bus lines used to output liquid crystal drive voltages of the drain drivers 130 as shown in FIG. 13 by way of example.

It must be noted here that in the example shown in FIG. 13, thirty-six internal bus lines (e.g., 6 bits×3 (R·G·B bus lines)×2=36) of self drain drivers 130 and an equivalent number of internal signal lines are required, resulting in an undesired increase in areas of semiconductor chips making up the drain drivers 130.

In contrast, with the embodiment, the display data transfer internal signal lines are arranged so that they are formed of some of the internal bus lines inherently used to output liquid crystal drive voltages of the drain drivers 130; thus it is possible to reduce the areas of the semiconductor chips when compared to the example shown in FIG. 13.

Turning back to FIG. 10, an operation of the operational circuits (21, 22) will next be explained below.

Display data transfer lines for connection between the timing controller of FIG. 1 and the "top" drain driver 130 plus each drain driver 130 operatively associated therewith are encountered with a problem as to electrical power consumption (such as charge-up/discharging at the transfer lines or else) due to a change in display data.

One example is that in case certain nine lines of three-pixel (×6 bits=18 lines) display data are at the "High" level whereas the remaining nine lines are at "Low" level with the next three-pixel display data items being at this inversion level, all the display data of eighteen lines will change resulting in an increase in power consumption due to chargeup/discharge at the display data transfer lines: the greater the operation speed and amplitude, the more the power consumption.

Then, in order to suppress the power consumption due to the state, the timing controller 110 is specifically designed so that a single data inversion signal (POL signal shown in FIG. 2) is provided for pre-execution of processing of eighteen display data items based on the data inversion signal while letting only the data inversion signal be inverted in level for external delivery without performing change of the eighteen display data items.

The operational circuit 21 of each drain driver 130 is the circuit which processes these signals to thereby realize the same function as that in a case where nine lines of the three-pixel (×6 bits=18 lines) display data are at High level whereas the remaining nine line are at Low level with the next three-pixel display data generating this inversion level resulting in absence of any data inversion signal, thus reducing or minimizing power consumption.

The operational circuit 21 is formed of an exclusive-OR or "Ex-OR" element, which outputs display data without executing inversion thereof when the data inversion signal (POL signal shown in FIG. 2) is at "0" and, when the data inversion signal (POL signal shown in FIG. 2) is at "1," outputs an inverted display data in a way as summarized in Table 1 below.

TABLE 1

| Input | | Output |
|---|---|---|
| Data Input Signal | Data Inversion Signal | A |
| 0 | 0 | 0 |
| 0 | 1 | 1 |
| 1 | 0 | 1 |
| 1 | 1 | 0 |

An operation of the operational circuit 22 will next be explained below.

The liquid crystal display panel 100 is driven by alternating current (AC)-modify drive methodology.

This AC-modify drive methodology includes common symmetry methods. With such common symmetry methods (e.g., a dot inversion method, n-line inversion method), it is required that a gradation voltage of the positive polarity and a gradation voltage of the negative polarity be applied to each pixel electrode.

Figure 14:
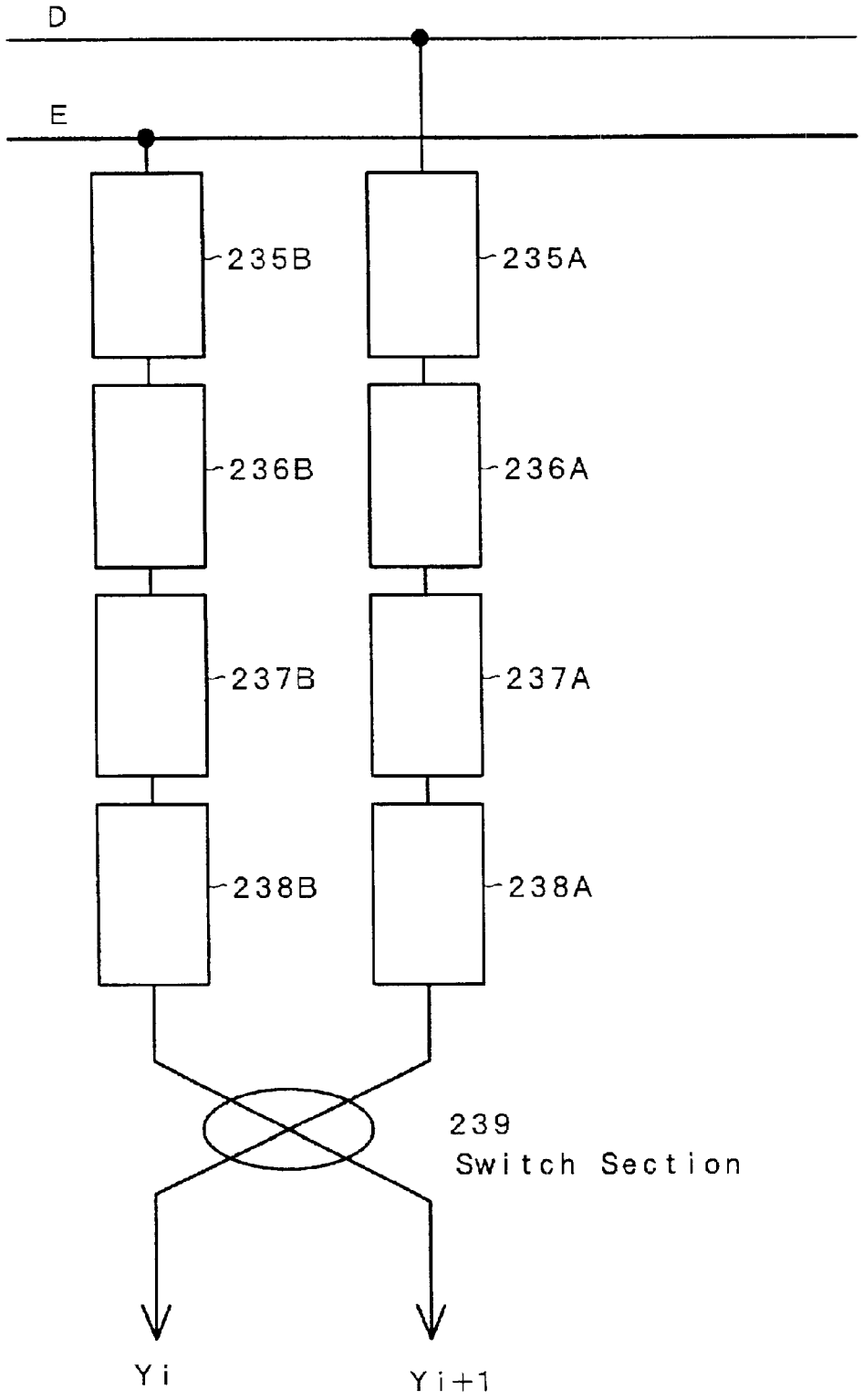
FIG. 14 is a diagram showing in greater detail a circuit configuration per combination of neighboring drain signal lines (Y) in units of respective colors of the drain driver of the embodiment 1 of the invention.

FIG. 14 is a diagram showing in greater detail a circuit configuration per combination of neighboring drain signal lines (Yi, Yi+1) in units of respective colors of the drain driver 130 of this embodiment.

In FIG. 14, "235A" and "235B" are used to designate respective latch circuits of the latch circuits (1) 135 shown in FIG. 2 whereas "236A" and "236B" denote respective latch circuits of the latch circuits (2) 136 shown in FIG. 2.

In addition, 237A and 237B indicate respective decoder circuits of the decoder circuits 137 shown in FIG. 2, wherein 237A is a high-voltage decoder circuit for selection of a positive gradation voltage whereas 237B is a low-voltage decoder circuit for selection of a negative gradation voltage.

Similarly 238A and 238B designate respective amplifier circuits of the amplifier circuits 138 shown in FIG. 2, wherein 238A is a high-voltage amplifier circuit for amplifying of the positive gradation voltage whereas 237B is a low-voltage amplifier circuit for amplification of the negative gradation voltage.

In this way, with this embodiment, a pair of positive polarity side circuit and negative polarity side circuit is provided in units of combinations of neighboring drain signal lines of respective colors in place of the positive polarity circuit and negative polarity circuit as provided in units of respective drain signal lines while supplying through changeover at a switch section 239 either a positive gradation voltage or a negative gradation voltage to a respective one of the neighboring drain signal lines in units of respective colors.

For instance, in the case of applying the positive gradation voltage to a drain signal line (Yi) while applying the negative gradation voltage to its neighboring drain signal line (Yi+1), the switch section 239 operates causing the drain signal line (Yi) to be connected to the positive voltage amplifier circuit 238A while connecting the drain signal line (Yi+1) to the low voltage amplifier circuit 238B; adversely, in the case of applying the negative gradation voltage to the drain signal line (Yi) while applying the positive gradation voltage to the drain signal line (Yi+1), the switch section 239 operates letting the drain signal line (Yi) be connected to the low voltage amplifier circuit 238B while connecting the drain signal line (Yi+1) to the positive voltage amplifier circuit 238B.

However, the latch circuit 235 on the positive polarity side is connected to an internal bus line D shown in FIG. 10 whereas the latch circuit 235B on the positive polarity side is connected to an internal bus line E shown in FIG. 10.

Due to such connection, it is required, in order to supply the positive gradation voltage to the drain signal line (Yi), that display data for selection of the positive gradation voltage be sent forth toward the internal bus line D; adversely, in order to supply the negative gradation voltage to the drain signal line (Yi), it is required that display data for selection of the negative gradation voltage be sent forth to the internal bus line E.

The operational circuit 22 is provided for sending the above-noted display data to either the internal bus line D or the internal bus line E shown in FIG. 10.

The operational circuit 22 is formed of switch circuits (61, 62), wherein one switch circuit 61 is operable to select any one of display data as output from the flip-flop circuit 3 and display data being output from the flip-flop circuit 2 in accordance with either "1" or "0" level of control signal for AC driving (M signal shown in FIG. 2) and then send out the selected one to the internal bus line D.

Similarly the other switch circuit 62 selects any one of the display data as output from the flip-flop circuit 2 and display data being output from the flip-flop circuit 3 in accordance with either "0" or "1" level of the control signal for AC driving (M signal shown in FIG. 2) and then passes the selected one to the internal bus line E.

Here, the AC driving signal (M) being supplied to the switch circuit 62 is an inverted signal of the control signal for AC driving (M) as supplied to the switch circuit 61; accordingly, in case the display data being sent to the internal bus line D is the display data as output from the flip-flop circuit 3 (or alternatively flip-flop circuit 2), the display data being passed to the internal bus line E becomes the display data to be output from the flip-flop circuit 2 (or alternatively flip-flop circuit 3).

Figure 15:
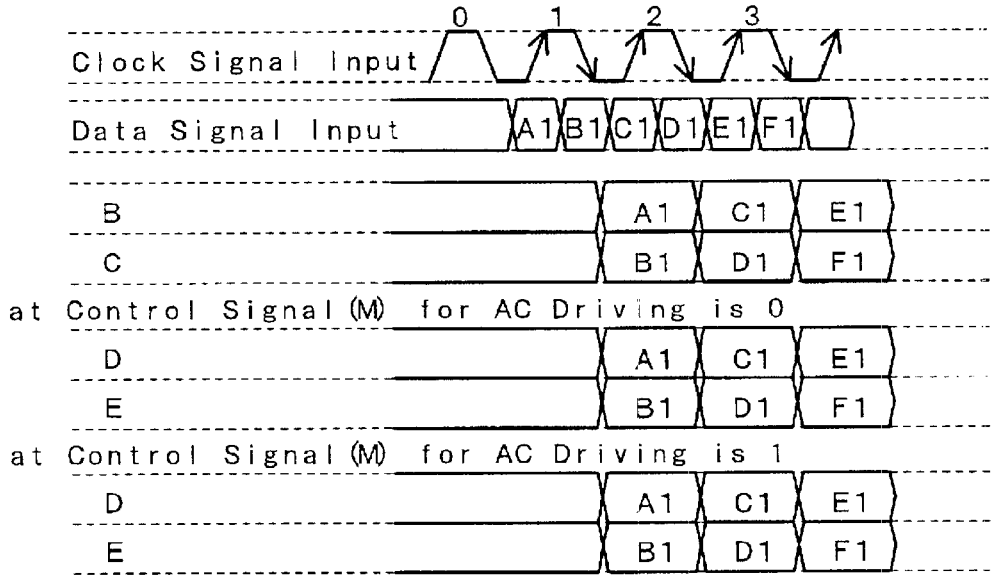
FIG. 15 is a diagram showing the processing content of an arithmetical processing circuit 22 shown in FIG. 10.

An arithmetic computation content of this operational circuit 22 is shown in FIG. 15.

An operational circuit 24 is the circuit which executes its arithmetical processing (logical) operation that is inverse to that of the operational circuit 21.

This operational circuit 24 is formed of Exclusive-OR circuits that are provided in units of two systems of internal bus lines (D, E) and is the circuit that further inverts based on a data inversion signal the display data as has been inverted by the operational circuit 21 while outputting display data that has not been inverted at the operational circuit 21 in a way such that the latter data remains in its present state.

In view of the fact that those display data items being sent onto the two systems of internal bus lines (D, E) have been interchanged in the order of sequence depending on the polarity of the AC-driving signal M, an operational circuit 25 is the circuit that permits alteration of the selection order of the flip-flop circuit 4 and flip-flop circuit 5 at the multiplex circuit 41 in order to again change and sort this order into the order of input of such display data.

Figure 16:
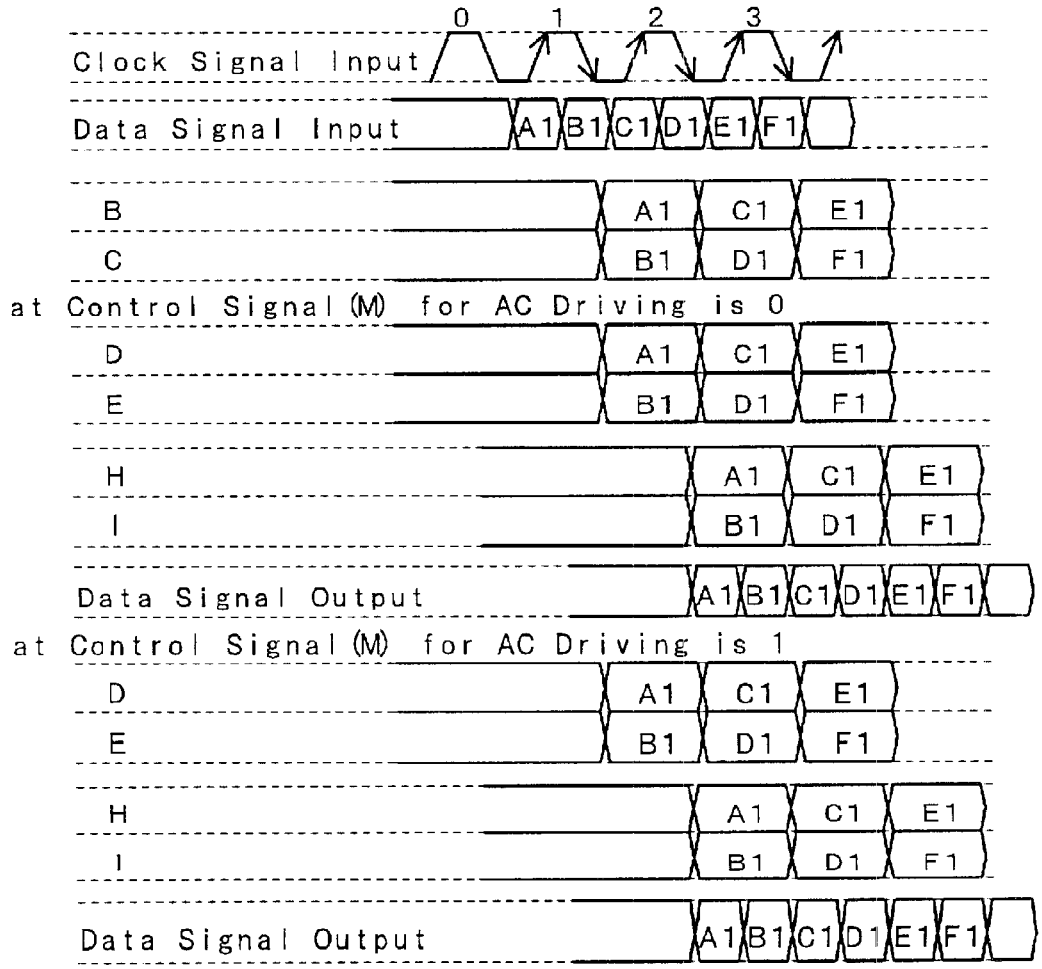
FIG. 16 is a diagram showing the processing content of an arithmetical processor circuit 25 shown in FIG. 10.

An arithmetic processing content of this operational circuit 25 is shown in FIG. 16.

As shown in FIG. 16, this operational circuit 25 permits output of display data in the order of the internal bus line D→internal bus line E→internal bus line D when the AC-driving signal M is at "0" while allowing such display data to be output in the order of the internal bus line E→internal bus line D→internal bus line E when the AC-driving signal M is at "1."

As has been explained in conjunction with the operational circuit 24, the display data to be transferred is required to inverse-process display data as processed by the operational circuit 21.

Then, in the illustrative embodiment, it takes thereinto this data inversion signal also in synchronism with the clock signal (CLL2) by use of the flip-flop circuit 6 to flip-flop circuit 8; additionally, in view of the fact that those display data being sent onto the two systems of internal bus lines (D, E) have been interchanged in order of sequence by the AC-driving signal M as described previously, switch circuits (63, 64) of the operational circuit 23 are operable to send forth data inversion signals as output from the flip-flop circuit 7 and flip-flop circuit 8 to internal signal lines (J, K) in a split fashion.

The data inversion signals on these internal signal lines (J, K) will be input to Exclusive-OR circuits as provided in units of two systems of internal bus lines (D, E) in the operational circuit 24, respectively.

In addition, the data inversion signals on the internal signal lines (J, K) are taken into a flip-flop circuit 9 and flip-flop circuit 10 at a rise-up time point of the clock signal (CLL2); then, the operational circuit 26 allows the selection order of the flip-flop circuit 9 and flip-flop circuit 10 to be modified at the multiplex circuit 42 causing the resultant interchanged data inversion signals on the internal signal lines (J, K) to return to the original states thereof for output to the outside.

An explanation will next be given of an operation of the delay circuit 51.

Figure 17:
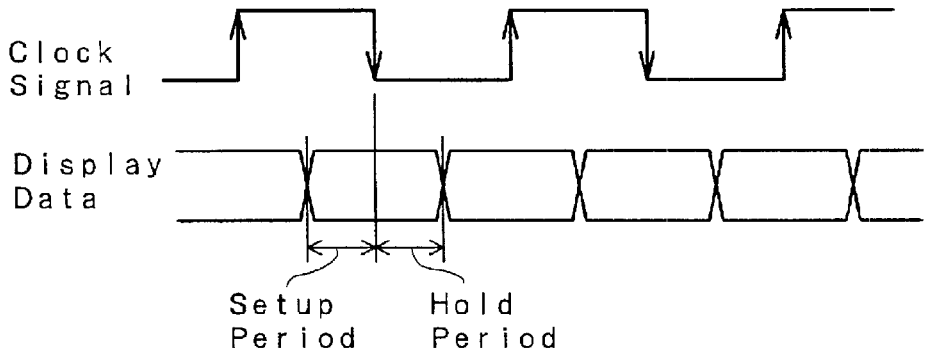
FIG. 17 is a diagram for explanation of a display data accept/import time point.

As shown in FIG. 17, in the case of a dual-edge accept scheme for taking or "accepting" display data at both the rise-up time point and drop-down point of a clock signal, it is required in order to provide marginal spaces or "clearances" in the setup period and hold period, that the clock signal (CLL2)'s riseup point and dropdown point be each placed at an intermediate point between time points whereat display data changes.

However, as readily understandable from the timing chart shown in FIG. 12, this embodiment is such that changeover points of display data as sent from the multiplex circuit 41 are identical to the riseup point and dropdown point of the clock signal (CLL2).

This makes it impossible for a drain driver 130 at the next stage to take any display data into the flip-flop circuits 1–3.

The delay circuit 51 is provided for delaying the phase of the externally output clock signal (CLL2) to thereby solve the problem stated supra.

Figure 18:
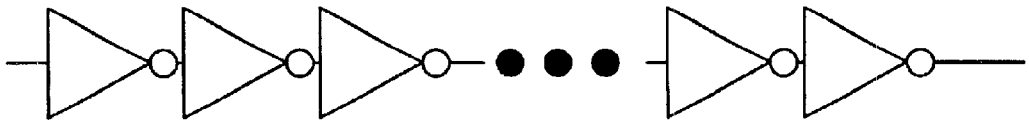
FIG. 18 is a circuit diagram showing one example of a delay circuit 51 shown in FIG. 10.

FIG. 18 is a circuit diagram showing one example of the delay circuit 51 shown in FIG. 17.

The circuitry shown in FIG. 18 is formed of a prespecified number, n, of cascade-connected inverter circuits, wherein this inverter circuit number (n) is set up to ensure that the delay amount of a clock signal (CLL2) due to these inverter circuits is at a specific delay amount (90°) which causes the clock signal (CLL2)'s riseup point and dropdown point to stay at the intermediate points between the display data's changeover points as shown in FIG. 17.

Figure 19:
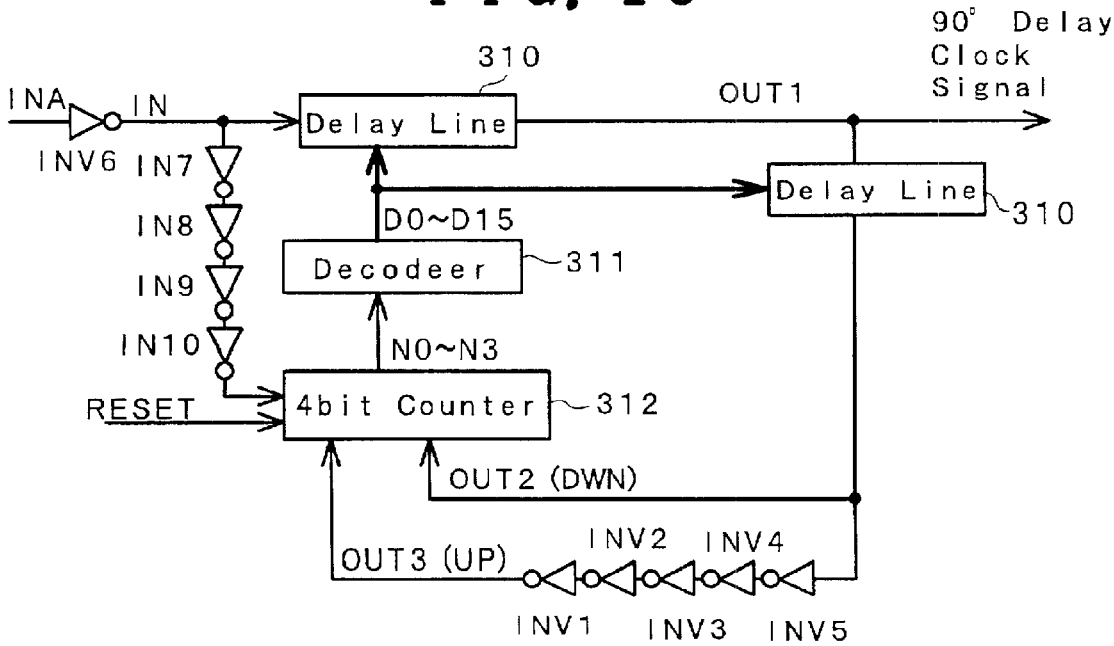
FIG. 19 is a circuit diagram showing another example of the delay circuit 51 shown in FIG. 10.

FIG. 19 is a circuit diagram showing another example of the delay circuit 51 shown in FIG. 17.

This circuitry shown in FIG. 19 is the afore the delay locked loop circuit as has been explained in conjunction with FIGS. 6 to 8: in this case, a clock signal (ft) delayed by 90° is to be obtained from OUT1.

Figure 20:
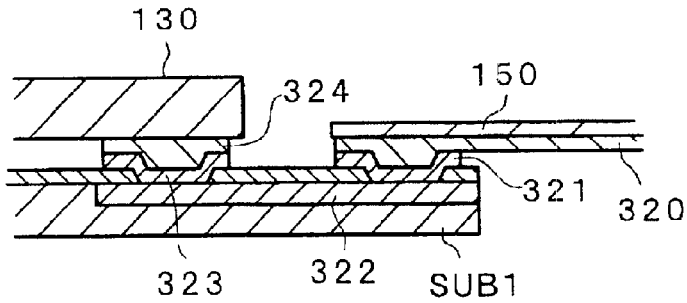
FIG. 20 is a pictorial cross-sectional diagram for explanation of a method for connecting a drain driver(s) and FPC substrate plus glass substrate.

FIG. 20 is a pictorial cross-sectional diagram for explanation of a method for connection of a drain driver 130 and an FPC substrate 150 plus a glass substrate.

As shown in FIG. 20 a power supply voltage is supplied to the drain driver 130 through a lead wiring layer 320 of the FPC substrate 150→a metallize layer 321 of the glass substrate SUB1→a wiring layer 322 of glass substrate SUB1→a metallize layer 323 of glass substrate SUB1→a bump electrode 324 of the drain driver (semiconductor chip) 130 in this order of sequence.

Figure 21:
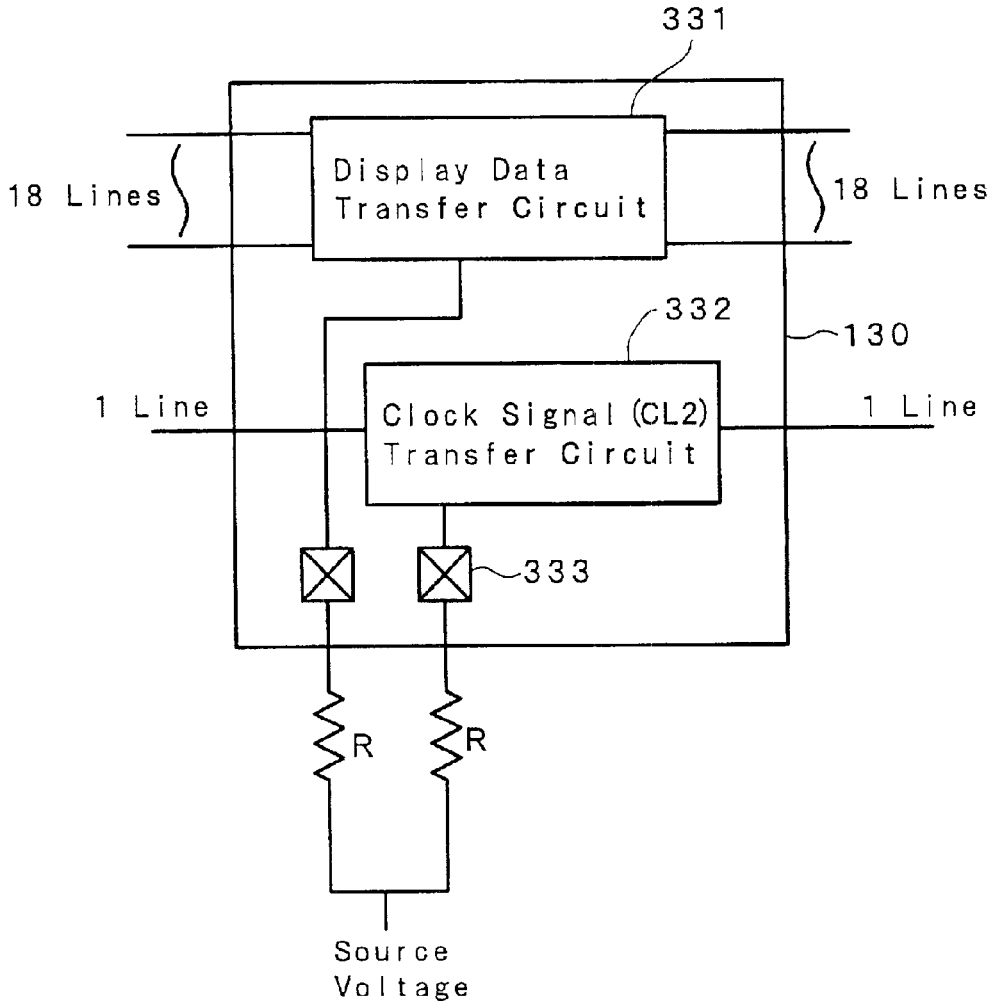
FIG. 21 is a diagram showing a system for supplying of a power supply voltage to the drain driver of the embodiment 1 of the invention.

In this case the illustrative embodiment is arranged so that electrical power to be supplied to a display data transfer circuit (e.g., multiplex circuit 41 or the like) 331 and power being fed to a clock signal transfer circuit (e.g., delay circuit 51 or else) 332 are separated from each other as shown in FIG. 21.

More specifically, power is supplied to the display data transfer circuit 331 and the clock signal transfer circuit 332 via separate pad electrodes 333 and power feed lines respectively.

Figure 22:
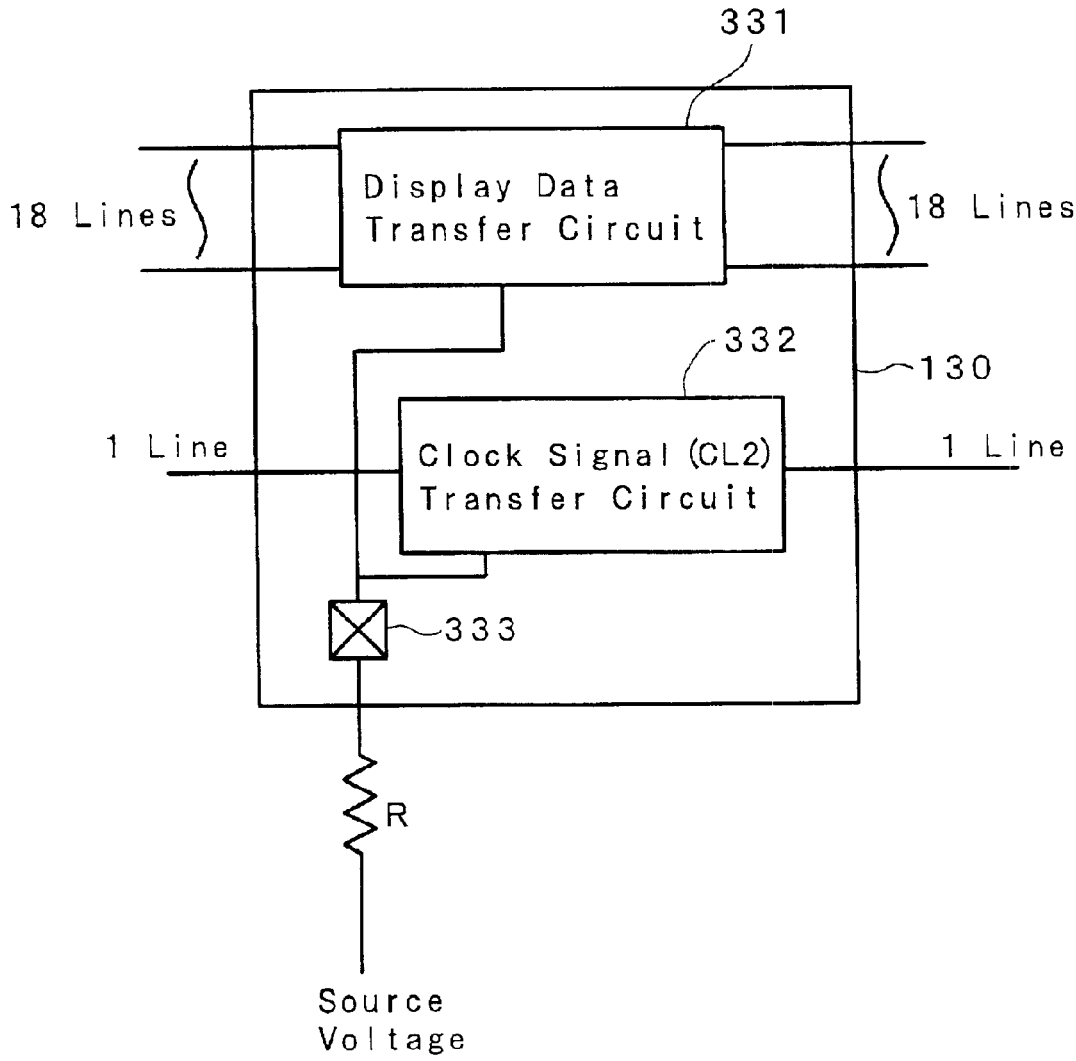
FIG. 22 is a diagram showing a power supply voltage supply system in a case where power to be supplied to a display data transfer circuit is not separated from power being fed to a clock signal transfer circuit.

Note here that FIG. 21 is a diagram showing a system for supplying a power supply voltage to the drain driver 130 of this embodiment: in this FIG. 22, a resistance R indicates a resistive component between the glass substrate's metallize layer 321→the glass substrate's wiring layer 322→glass substrate's metallize layer 323→the bump electrode 324 of the drain driver (semiconductor chip) 130.

While FIG. 22 is a diagram showing a power supply voltage supply system in the case where electrical power to be supplied to the display data transfer circuit 331 is not separated from power being fed to the clock signal transfer circuit 332, the example shown in this FIG. 22 is such that currents flowing in the multiplex circuit 41 of the display data transfer circuit 331 are required for certain number corresponding to the bit number of display data whereby voltage reduction at the aforementioned resistance R increases so that the power supply voltage being supplied to the clock signal transfer circuit 332 decreases in potential accordingly resulting in a decrease in amplitude of the clock signal (CLL2).

However, since this embodiment is specifically arranged so that the power being supplied to the display data transfer circuit 331 and the power to be fed to the clock signal transfer circuit 332 are separated from each other, it will no longer happen that the power supply voltage being supplied to the clock signal transfer circuit 332 potentially decreases causing the clock signal (CLL2) to likewise decrease in amplitude.

In brief, with this embodiment, it becomes possible to suppress influence of the display data transfer circuit 331 upon the clock signal transfer circuit 332.

Embodiment 2

Figure 23:
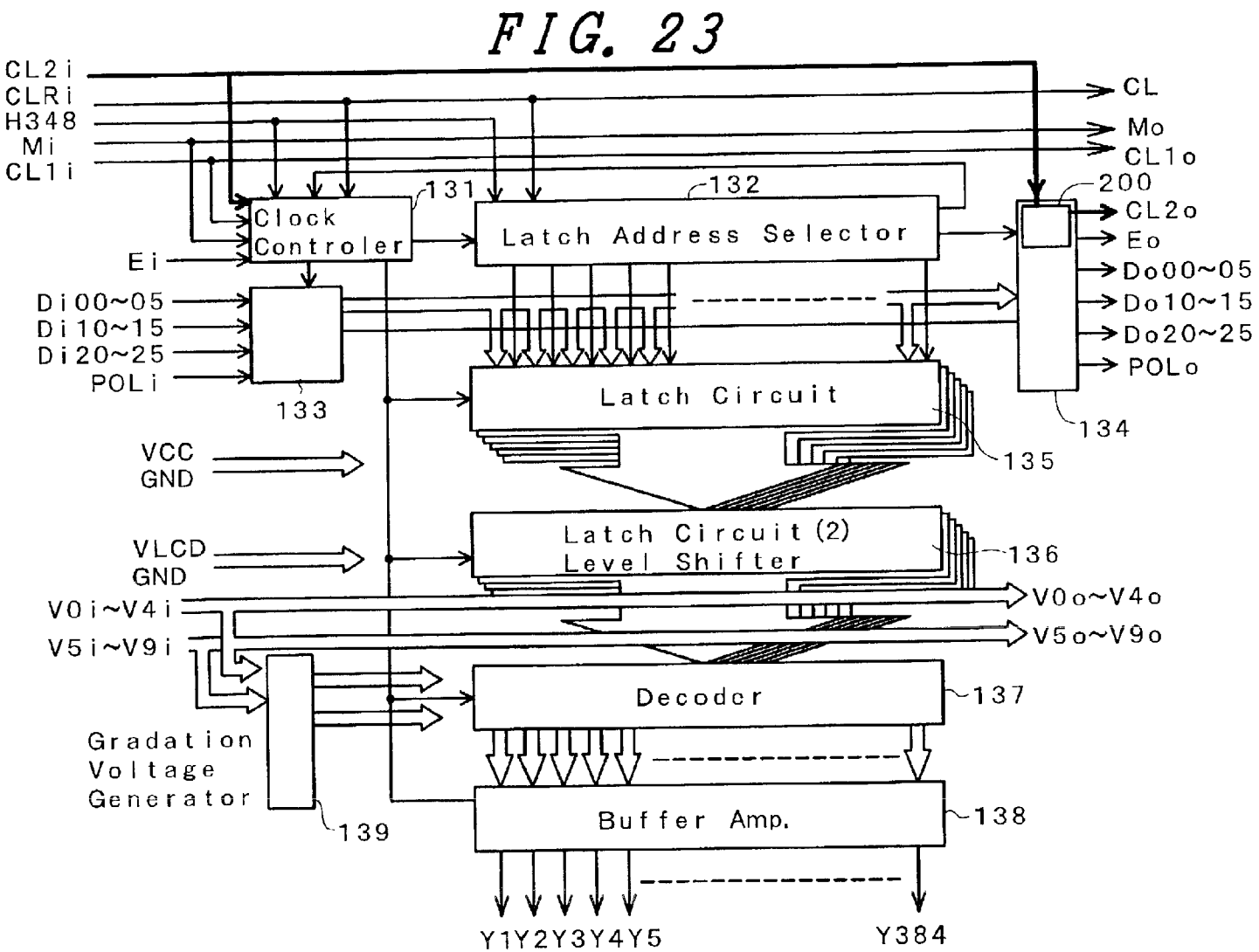
FIG. 23 is a block diagram schematically showing an arrangement of a drain driver of an embodiment 2 of the instant invention.

FIG. 23 is a block diagram schematically showing a configuration of a drain driver of an embodiment 2 of the instant invention.

This embodiment is different from the embodiment 1 in that the clock compensation circuit 200 is provided within the data output circuit 134.

In this embodiment a clock as generated by the clock compensation circuit 200 provided within the data output circuit is delayed at the above-noted delay circuit 51 and then output to a drain driver 130 at the next stage.

Note that any detailed explanation as to the operation of each component within the drain driver 130 of this embodiment is eliminated herein since such operation is similar in principle to that stated supra with the internal clock signal (CLL2) being replaced for interpretation with the clock signal (CL2) as used in the above explanation.

Further note that the insertion position of the clock compensation circuit 200 should not be limited to any one of the clock signal input side of the drain driver 130 as in the embodiment 1 and the clock signal output side of drain driver 130 as in this embodiment: it would be obvious that the same operabilities and effects as those stated above are attainable by insertion of the clock compensation circuit 200 into a transfer line path or route along which the externally input clock signal (CLL2) is output to the outside.

Embodiment 3

Figure 24:
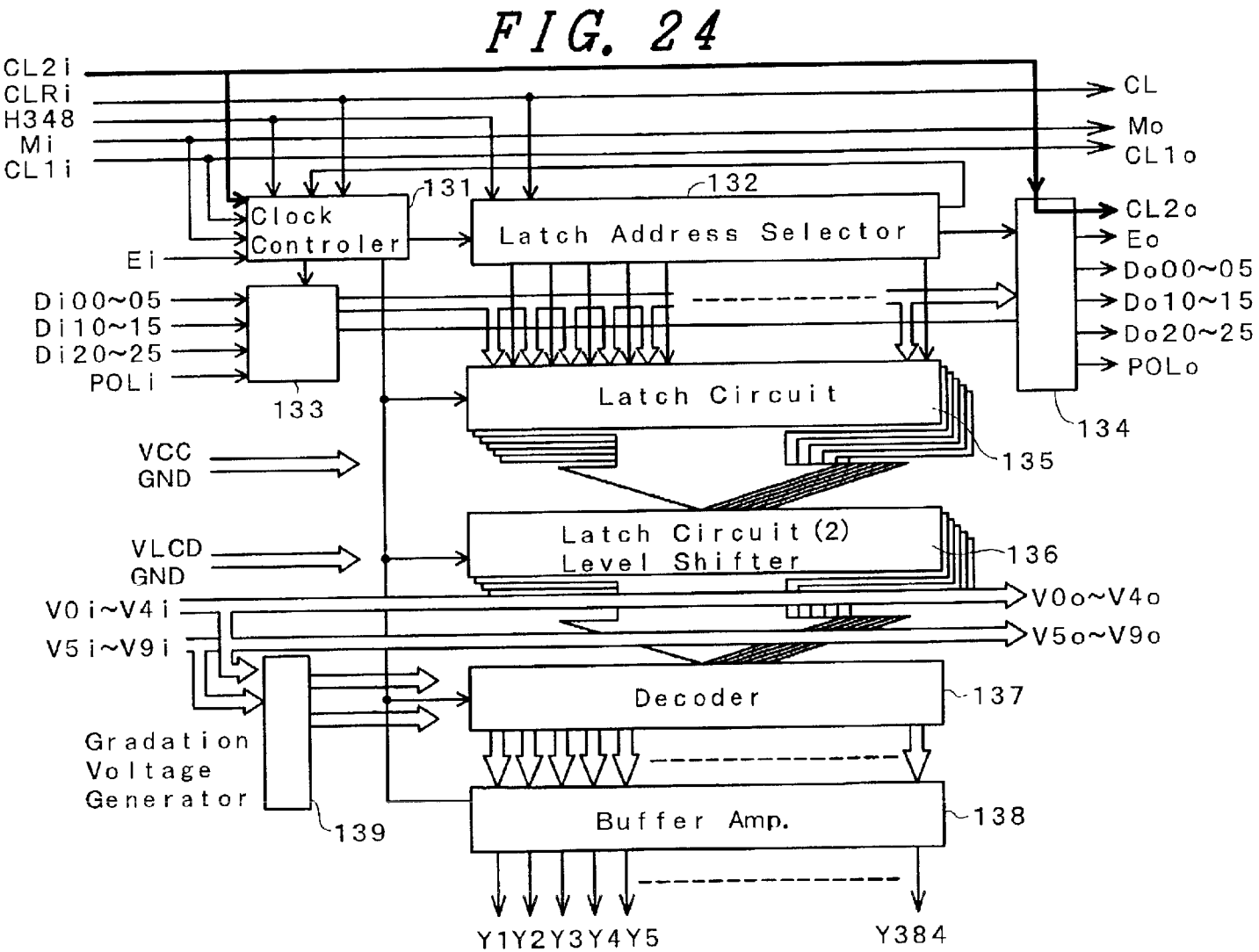
FIG. 24 is a block diagram schematically showing a configuration of a drain driver of an embodiment 3 of the invention.

FIG. 24 is a block diagram schematically showing a configuration of a drain driver of an embodiment 3 of the invention.

Figure 25:
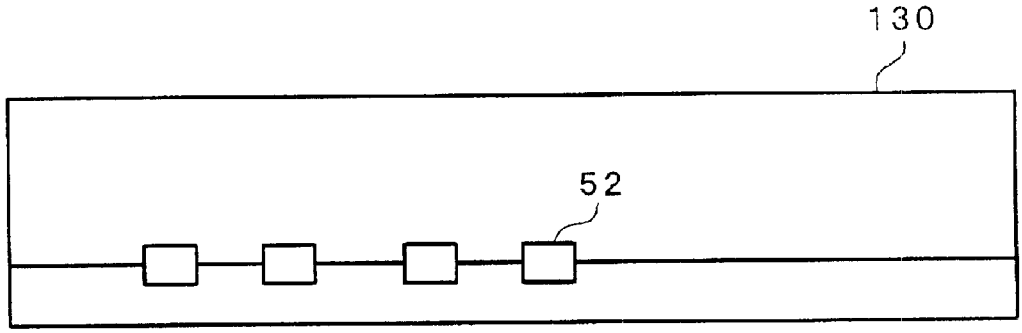
FIG. 25 is a diagram for explanation of a clock compensation method of the embodiment 3 of the invention.

This embodiment is such that the clock compensation circuit 200 of each embodiment is replaced with a circuit element (e.g., inverter circuit) 52 as provided within each drain driver 130 and inserted into the transfer line path along which an externally input clock signal (CL2) is output to the outside as shown in FIG. 25, wherein the circuit element is designed to set the number of logical level changes at odd numbers.

As previously stated, in CMOS inverter circuits, a change in threshold voltage (Vth) of each MOS transistor results in an output pulse signal changing in duty ratio (i.e. the ratio of a "High" level period to the period of such pulse signal).

Due to this, in liquid crystal display devices of the type employing the digital signal sequential transfer scheme, several duty ratio changes of the clock signal (CL2) are accumulated while the clock signal (CL2) is being transferred via respective drain drivers 130, resulting in an increase in phase difference with respect to display data.

However, letting the number of logical level changes of the clock signal (CL2) being transferred at respective drain drivers 130 be set at an odd number in the way stated above guarantees that even when the clock signal (CL2) changes so that its duty ratio becomes greater at a drain driver 130 of a previous stage, the clock signal (CL2) will change so that its duty ratio gets smaller at a drain driver 130 of the next stage.

Whereby it becomes possible to reduce or suppress the duty ratio changeability of the clock signal (CL2) as a whole.

Note that a detailed explanation as to the operation of each component within the drain driver 130 of this embodiment is omitted herein since such operation is similar in principle to that stated above with the internal clock signal (CLL2) being replaced for interpretation with the clock signal (CL2) as used in the above explanation.

It has been stated that while a method for transferring display data through inversion to a drain driver at the next stage in order to prevent unwanted duty ratio variation is disclosed in the above-cited related art reference (SHARP Technical Bulletin, No. 74 (August 1999) at pp. 31–34), this embodiment is different from the related art in that display data is output to the next stage in a way synchronous with the clock signal (CL2) and that the clock signal (CL2) alone is inverted without having to invert the display data per se.

The one as taught by the above reference lacks any idea of letting the display data be output in synchronism with a clock(s); thus, all the display data items must be inverted for outputting in order to prevent duty ratio variation or fluctuation.

Accordingly the next-stage drain driver must be a negative logical drain driver in view of the fact that it is strictly required to generate a liquid crystal drive voltage on the basis of such inverted display data, which would result in occurrence of several demerits including but not limited to an increase in types of drain drivers used and in an increase in production costs and further in an increase in complexity of manufacturing process of liquid crystal display devices leading to a decrease in production yields thereof.

In contrast, with the present invention, outputting display data to the next-stage drain driver in away synchronous with the clock signal (CL2) voids the necessity of inverting and then outputting the display data, which permits the next-stage drain driver to be also formed of the same logic drain driver; thus, production costs may be lowered while making easier the manufacture of any intended liquid crystal display devices with increased production yields.

In addition, with this invention, although the clock signal (CL2) is to be inverted and then output in order to preclude duty ratio variation, the next-stage drain driver may be designed so that a special control circuit is provided with respect to the clock signal (CL2) only; thus it is possible to arrange the intended liquid crystal display device by use of those drain drivers of the type having a single type of logical operability with simplified circuit configuration.

Practically in this embodiment, each drain driver is provided with a circuit that makes native or "forward" clocks and inverted clocks equal to each other in timing of accepting a start pulse of each drain driver in response to the clock signal (CL2).

Figure 26:
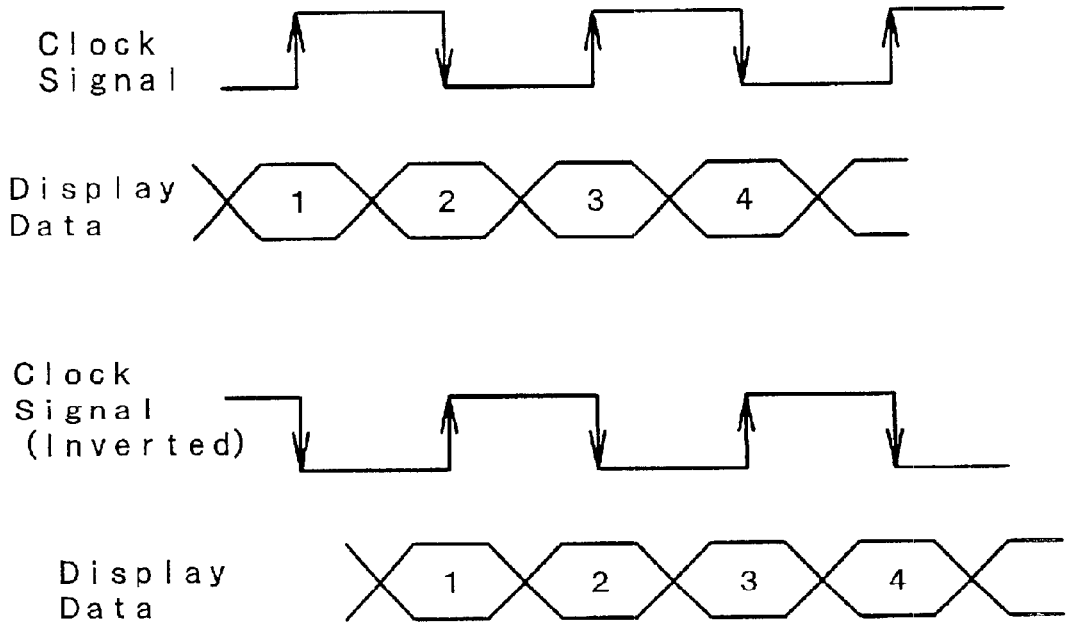
FIG. 26 is a diagram for explanation of a relation of one exemplary clock signal versus display data in the embodiment 3 of the invention.

Alternatively, as shown in FIG. 26, let the display data to be transferred to the next-stage drain driver 130 be delayed by a specified time (e.g., 90°).

In FIG. 26 a forward clock signal represents a clock signal (CL2) being input to a pre-stage drain driver 130 whereas an inverted clock signal is indicative of a clock signal (CL2) as input to a rear-stage drain driver 130.

With this example shown in FIG. 26, at the pre-stage drain driver 130, display data (1) is taken into drain driver 130 at a rise-up edge of the forward clock signal and further 90°-delayed by a delay circuit for example for delivery to the next-stage drain driver 130; thus, even at the next-stage drain driver 130, the display data (1) is taken into drain driver 130 at the inverted clock signal's rise-up edge.

Note here that even with the method for outputting through inversion the display data to the next-stage drain driver, drain driver commonization is still made possible by providing in each drain driver a circuit for recovering such polarity-inverted display data to the display data with its original polarity and a circuit for controlling polarities of display data.

However, what has been stated above is not taught by nor suggested in any way from the above-identified related art reference (*SHARP Technical Bulletin*, No. 74 (August 1999) at pp. 31–34), which does require circuitry for controlling display data polarity inversion operations in units of respective bits of display data, resulting in occurrence of a demerit as to increase in scale of resultant circuitry.

Embodiment 4

Figure 27:
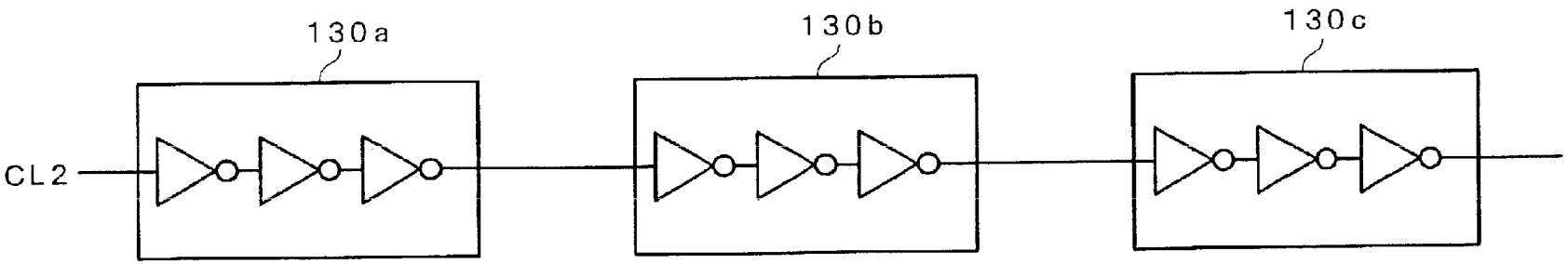
FIG. 27 is a diagram showing in simplified block form a transfer route of a clock signal (CL2) of the embodiment 3 of the invention.

FIG. 27 is a diagram showing in simplified block form a transfer line path or "route" of the clock signal (CL2) of the the embodiment.

As previously stated, with the technique as disclosed in the related art document, each driver is designed to transfer display data to its next-stage drain driver after completion of inversion thereof.

In addition the clock signal used therein consists of only one system.

With the related art technique, if a clock signal (CL2) as input to a drain driver is at "H" level then a clock signal (CL2) being input to its next-stage drain driver is at "L" level and a clock signal (CL2) to be input to its further next-stage drain driver becomes at H level.

Due to this, a need is felt to prepare two types of drain drivers.

More specifically it should be required to prepare both drain drivers (e.g., 130*a*, 130*c* of FIG. 27) with logical arrangements under the assumption that display data and a native or "forward" signal of clock signal (CL2) are input thereto and more than one drain driver (e.g., 130*c* in FIG. 27) with a logical arrangement under the assumption that an inverted signal(s) is/are input thereto.

In this way, the drain drivers as recited in the related art document is encountered with a disadvantage that liquid crystal drive circuitry is complicated in configuration.

Figure 28:
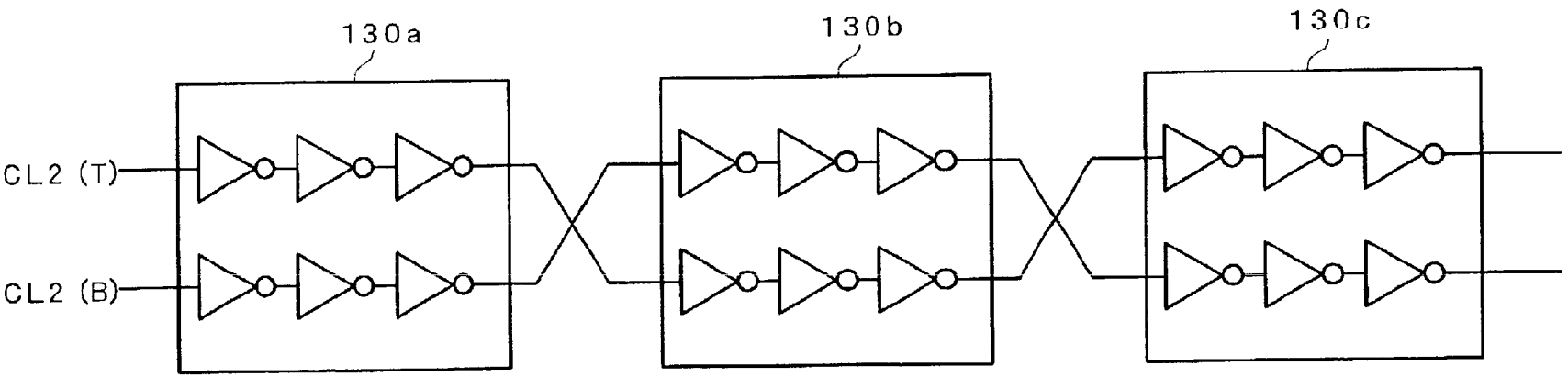
FIG. 28 is a diagram showing in simplified block form a transfer route of a clock signal (CL2) of an embodiment 4 of the invention.

FIG. 28 is a diagram showing in simplified block form a clock signal (CL2) transfer route of an embodiment 4 of the invention.

In this embodiment, both forward clocks (CL2(T)) of the clock signal (CL2) and inverted clocks (CL2(B)) of the clock signal (CL2) are input to respective drain drivers (130*a*, 130*b*, 130*c*).

Here, as in the embodiments, the forward clocks (CL2(T)) and inverted clocks (CL2(B)) are specifically designed so that the logic level change/inversion number thereof becomes an odd number in the transfer route via respective drain drivers.

Additionally, in FIG. 28 also, an odd number of the logic level changing number of the forward clocks (CL2(T)) and inverted clocks (CL2(B)) is represented by a series connection of three inverters.

In this embodiment also, even when a change is found at a pre-stage drain driver (e.g., 130*a*) to increase the duty ratios of a forward clock (CL2(T)) and inverted clock (CL2(B)), a change is done at its next-stage drain driver (e.g., 130*b*) letting both the forward clock (CL2(T)) and the inverted clock (CL2(B)) decrease in duty ratio.

Whereby it becomes possible as a whole to lessen any possible changes in duty ratios of the forward clock (CL2(T)) and inverted clock (CL2(B)) of a clock signal (CL2).

Furthermore, this embodiment is arranged to change over or switch transfer lines (transfer lines on glass substrate) between respective drain drivers with forward clocks (CL2(T)) and inverted clocks (CL2(B)) being transferred thereto for inputting a forward clock (CL2(T)) being output from a pre-stage drain driver (e.g., 130*a*) as an inverted clock (CL2(B)) of its next-stage drain driver (e.g., 130*b*) while at the same time inputting an inverted clock (CL2(B)) to be output from the pre-stage drain driver (e.g., 130*a*) as a forward clock (CL2(T)) of the next-stage drain driver (e.g., 130*b*).

With the use of such arrangement, those clock signals as input to forward clock (CL2(T)) input terminals of respective drain drivers (130*a*, 130*b*, 130*c*) become identical in level together, thereby avoiding the need to provide any special control circuitry with respect to the clock signal (CL2) only while also precluding the necessity of preparing two types of drain drivers.

Figure 29:
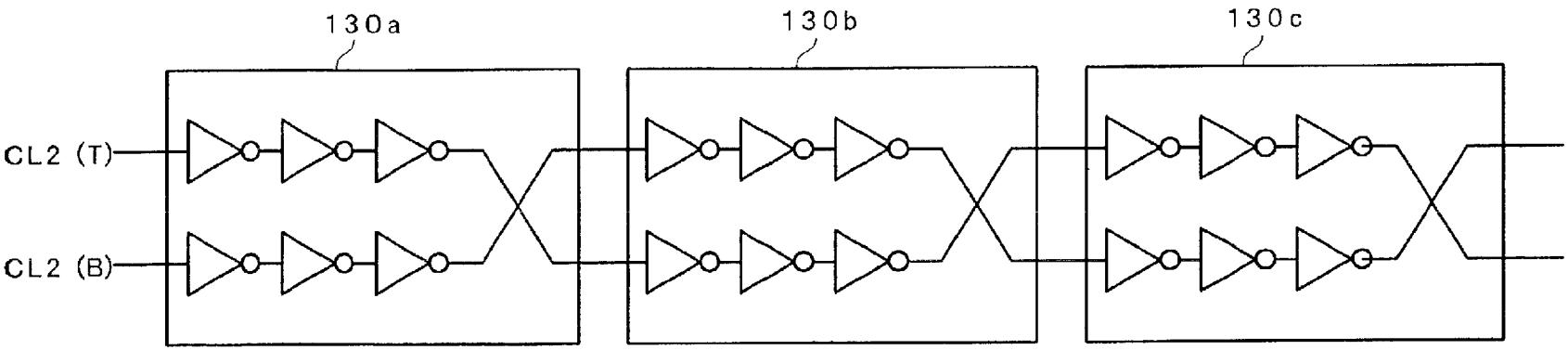
FIG. 29 is a diagram showing in simplified block form a modified example of the transfer route of the clock signal (CL2) in the embodiment 4 of the invention.

It should be noted that this embodiment may alternatively be modified so that internal signal lines with the forward clock (CL2(T)) and inverted clock (CL2(B)) transferred thereto are switched within each drain driver (130*a*, 130*b*, 130*c*) for inputting a forward clock (CL2(T)) being output from the pre-stage drain driver (e.g., 130*a*) as the inverted clock (CL2(B)) of its next-stage drain driver (e.g., 130*b*) while simultaneously inputting an inverted clock (CL2(B)) to be output from the pre-stage drain driver (e.g., 130*a*) as a forward clock (CL2(T)) of the next-stage drain driver (e.g., 130*b*), as shown in FIG. 29.

Embodiment 5

Figure 30:
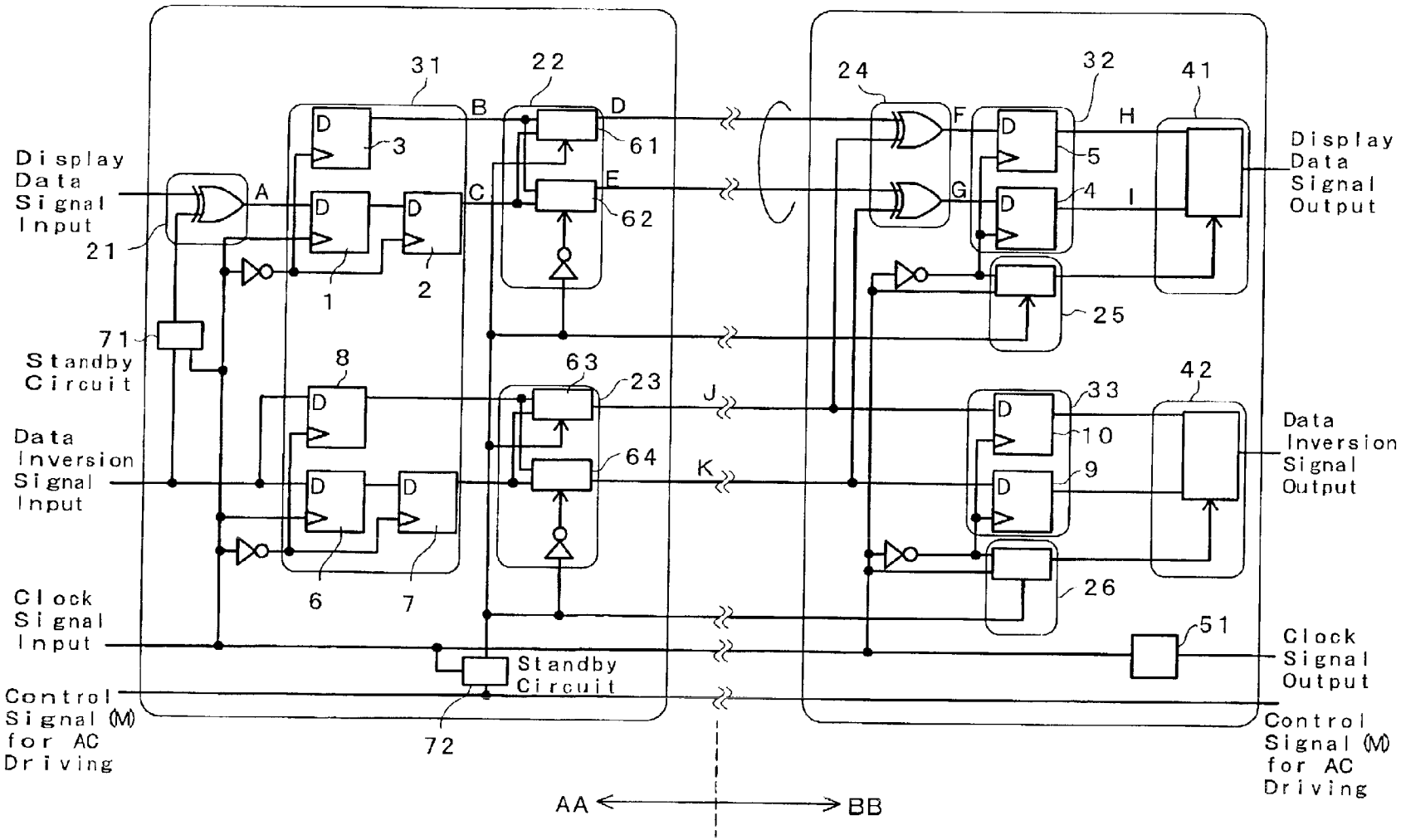
FIG. 30 is a circuit diagram showing circuit configurations of a data accept/processing circuit and data output circuit of an embodiment 5 of the invention.

FIG. 30 is a circuit diagram showing circuit configurations of a data accept/processing circuit 133 and a data output circuit 134 of an embodiment 5 of the invention.

In FIG. 30 also, part on the left side of dotted line (in the direction of arrow AA) is the data accept/processing circuit 133 whereas the other part on the right side of dotted line (in the direction of arrow BB) is the data output circuit 134.

As shown in FIG. 30, in this embodiment, a difference is seen from the data accept/processing circuit 133 and data output circuit 134 of the embodiment 1 shown in FIG. 10 in that stand-by circuits (71, 72) are added thereto.

Arithmetical processing or computation of the above-noted operational circuits (21, 22, 23) are required only in the event that externally input display data is the display data to be taken into or accepted within a self-drain driver.

In view of this, the illustrative embodiment is designed so that the standby circuits (71, 72) make the operational circuits (21, 22, 23) effective only when the external input display data is the display data to be accepted within the self-drain driver and, in other cases, make the operational circuits (21, 22, 23) ineffective.

Figure 31:
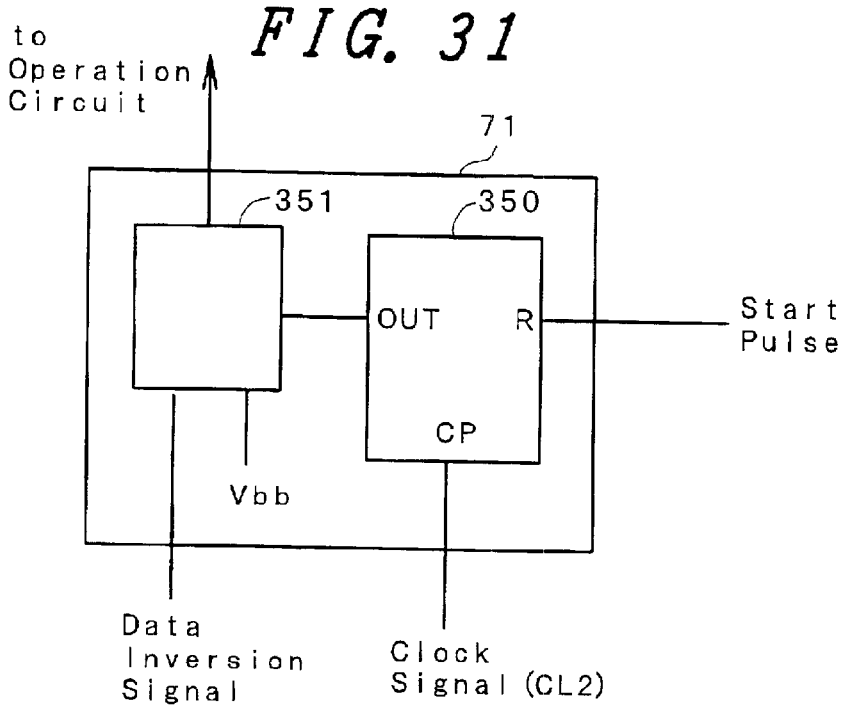
FIG. 31 is a block diagram showing a circuit configuration of a standby circuit shown in FIG. 30.
Figure 32A:
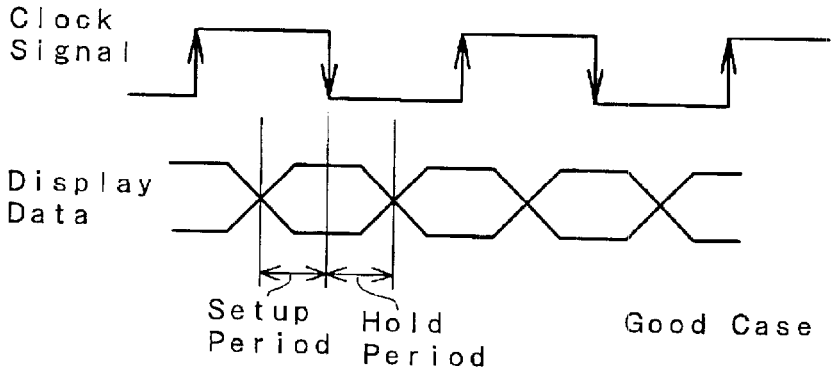
FIG. 32A Prior Art
FIG. 32 is a diagram for explanation of a setup period and a hold period in a dual-edge accept scheme.
Figure 32B:
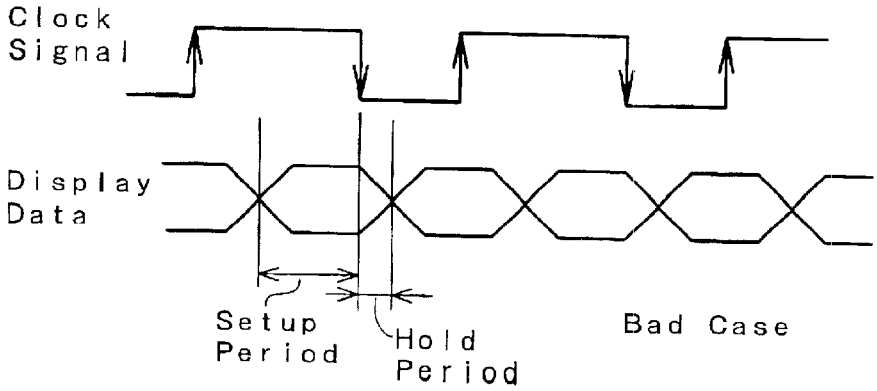
FIG. 32B Prior Art

FIG. 31 is a block diagram showing a circuit configuration of one standby circuit 71 shown in FIG. 30.

As shown in FIG. 31, at this standby circuit 71, a counter circuit 350 counts a clock signal or signals (CLL2) once at a time whenever a start pulse (display data accept start signal) is input thereto.

In addition, in case the resulting counter number of the counter circuit 350 is less than or equal to a prespecified count number, a switch circuit 351 outputs a data inversion signal; when the counter number of the counter circuit 350 exceeds the prespecified count number, the switch circuit 351 outputs a constant bias voltage (voltage with High level, or voltage with Low level or the like) Vbb.

Whereby the operational circuit 21 is expected to execute the arithmetic processing content shown in Table 1.

Additionally the other standby circuit 72 also is substantially the same in circuit configuration as the standby circuit 71.

According to this embodiment, it is possible to reduce power consumption because of the fact that any extra processing operations are no longer required in cases where the external input data is the display data that need not be accepted within the self-drain driver (in other words, mere display data to be transferred).

In addition, although in each embodiment described above the drain drivers 130 are directly mounted on or over the glass substrate of a liquid crystal display panel, the present invention should not be limited only to this arrangement and, obviously, may also be applicable to liquid crystal display devices of the type employing digital signal sequential transfer schemes with the drain drivers 130 being mounted on a tape carrier package.

Although the invention as made by the inventor as named herein has been described in detail and illustrated with reference to particular embodiments, it would readily occur to those skilled in the art that the invention should not be limited only to the embodiments and may be modified and altered in a variety of forms without departing from the true spirit and scope of the invention.

Effects and advantages of the representative one of those inventive concepts as disclosed herein will be briefly explained below.

(1) According to the liquid crystal display device of the present invention, since display data transfer is done by utilizing a data bus or buses within liquid crystal driver ICs, it is no longer required to employ wire leads of a printed circuit board for parallel transmission of display data to each liquid crystal driver IC, thus making it possible to lessen peripheral circuit regions of the liquid crystal display device.

(2) According to the liquid crystal display device, it becomes possible to well compensating for variation in duty ratios of clock signals as input to the liquid crystal driver circuitry.

(3) According to the liquid crystal display device, it is possible to prevent occurrence of any erroneous display in those images being visually displayed on the liquid crystal display element, thereby enabling improvement of the display quality of such images as displayed on the liquid crystal display element.

What is claimed is:

1. A liquid crystal display device having a liquid crystal display panel, a plurality of cascade-connected liquid crystal drive circuits for sequentially transferring a signal, and a plurality of signal lines formed over an edge portion of the liquid crystal display panel for transmitting a signal between any two of the drive circuits, wherein each of the liquid crystal drive circuits comprises:

an image input terminal connected with one of the signal lines to receive an external image signal being input thereto as an internal image signal into said each of the liquid crystal drive circuits;

a clock input terminal connected with another one of the signal lines to receive an external clock signal being input thereto;

a clock compensation circuit for generating an internal clock signal based on the external clock signal thereby compensating for a duty ratio deviation of the external clock signal, said internal clock signal swinging from a first voltage to a second voltage lower than the first voltage;

a data storage circuit for storing therein the internal image signal at a timing of a voltage change from the first voltage to the second voltage as a first image signal and at a timing of a voltage change from the second voltage to the first voltage of the internal clock signal as a second image signal;

a first data bus for transmitting the first image signal from the data storage circuit;

a second data bus for transmitting the second image signal from the data storage circuit;

a voltage select circuit for selecting a voltage according with he first and the second image signals to drive the liquid display panel; and a clock signal output circuit for outputting the internal clock signal as a subsequent external clock signal and for outputting the first image signal and the second image signal in sequence as a subsequent external image signal to a subsequent liquid crystal drive circuit, said clock signal output circuit having a delay circuit, wherein the delay circuit delays the internal clock signal to become the subsequent external clock signal to the subsequent liquid crystal drive circuit so as to provide phase margins thereof in a dual-edge accept scheme.

2. The liquid crystal display device as claimed in claim 1, wherein the clock compensation circuit has a phase locked loop circuit.

3. The liquid crystal display device as claimed in claim 1, wherein the clock compensation circuit has a delay locked loop circuit.

4. The liquid crystal display device as claimed in claim 1, wherein the data bus comprises two systems of signal lines.

5. The liquid crystal display device as claimed in claim 1, wherein the duty ratio deviation of the external clock signal is caused by at least one of an internal characteristic of the respective drive circuit and a factor on the signal lines.

6. The liquid crystal display device as claimed in claim 1, wherein the internal clock signal generated by the clock compensation circuit has a duty ratio of 50%.

7. The liquid crystal display device as claimed in claim 1, wherein the clock compensation circuit has an inverter.

8. The liquid crystal display device as claimed in claim 1, wherein the voltage select circuit selects the voltage according to the image signal on the data bus and then outputting the selected voltage.

9. A liquid crystal display device having a liquid crystal display element, a plurality of cascade-connected liquid crystal drive circuits, and a plurality of signal lines formed over an edge portion of the liquid crystal display element for transmitting a signal between any two of the drive circuits, wherein each of the liquid crystal drive circuits comprises:

a data input terminal connected with one of the signal lines to receive an external image signal being input thereto as an internal image signal into said each of the liquid crystal drive circuits;

a clock compensation circuit for inputting an external clock signal and outputting an internal clock signal, the internal clock signal having a first period for outputting a first voltage and a second period for outputting a second voltage;

a first data latch circuit for taking thereto the internal image signal at a timing of a voltage change from the first voltage to the second voltage of the internal cloak as a first image signal;

a second data latch circuit for taking thereto the internal image signal at a timing of a voltage change from the second voltage to the first voltage of the internal clock signal of the internal cloak as a second image signal;

a first data bus for transmitting the first image signal from the first data latch circuit;

a second data bus for transmitting the second image signal from the second data latch circuit;

a voltage output circuit for outputting a voltage selected according with the first and the second image signals on the first and second data buses to the liquid crystal display element;

a data output circuit for outputting the image signal on the data bus to a subsequent liquid crystal drive circuit;

a clock formation circuit being operable to correct a duty ratio deviation of the external clock signal to provide the internal clock signal; and a clock signal output circuit for outputting the internal clock signal as a subsequent external clock signal and for outputting the first image signal and the second image signal in sequence as a subsequent external image signal to a subsequent liquid crystal drive circuit, said clock signal output circuit having a delay circuit, wherein the internal clock signal is delayed to become the subsequent external clock signal by the delay circuit so as to provide phase margins thereof in a dual-edge accept scheme.

10. The liquid crystal display device as claimed in claim 9, wherein the clock formation circuit has a phase locked loop circuit.

11. The liquid crystal display device as claimed in claim 9, wherein the clock formation circuit has a delay locked loop circuit.

12. The liquid crystal display device as claimed claim 9, wherein the data bus comprises tow systems of signal lines.

13. The liquid crystal display device as claimed in claim 9, wherein the duty ratio deviation of the external clock signal is caused by at least one of an internal characteristic of the respective drive circuit and a factor on the signal lines.

14. The liquid crystal display device as claimed in claim 9, wherein the internal clock signal generated by the clock compensation circuit a duty ratio of 50%.

15. The liquid crystal display device as claimed in claim 9, wherein the clock formation circuit has an inverter.

* * * * *